US005382349A

United States Patent [19]

Yoshita et al.

[11] Patent Number: 5,382,349

[45] Date of Patent: Jan. 17, 1995

[54] METHOD OF TREATMENT OF HEAVY HYDROCARBON OIL

[75] Inventors: Mitsuru Yoshita; Kenichi Ii; Kazuhiro Kashima; Eiichiro Kanda; Takanori Ohno; Naotake Takeuchi, all of Sodegaura, Japan

[73] Assignee: Idemitsu Kosan Co., Ltd., Tokyo, Japan

[21] Appl. No.: 945,121

[22] Filed: Sep. 14, 1992

[30] Foreign Application Priority Data

Oct. 9, 1991 [JP] Japan ..... 3-261871

[51] Int. Cl.[6] ..... C10G 65/02; C10G 67/02; C10G 69/02; C10G 69/06

[52] U.S. Cl. ..... 208/49; 208/58; 208/61; 208/78; 208/79; 208/89; 208/97

[58] Field of Search ..... 208/49, 58, 61, 78, 208/79, 89, 97

[56] References Cited

U.S. PATENT DOCUMENTS

| | | | |
|---|---|---|---|
| 3,338,819 | 8/1967 | Wood | 208/99 |
| 3,380,910 | 4/1968 | Griffiths | 208/58 |
| 3,751,360 | 8/1973 | Bernstein et al. | 208/58 |
| 3,852,207 | 12/1974 | Stangeland et al. | 208/58 |
| 4,415,436 | 11/1983 | Agevine | 208/89 |
| 4,446,008 | 5/1984 | Shimakawa et al. | 208/111 |
| 4,447,314 | 5/1984 | Banta | 208/89 |
| 4,511,458 | 4/1985 | Billon et al. | 208/89 |
| 4,576,709 | 3/1986 | Miller et al. | 208/61 |
| 4,626,340 | 12/1986 | Galiasso et al. | 208/89 |
| 4,784,745 | 11/1988 | Nace | 208/61 |
| 4,797,195 | 1/1989 | Kukes et al. | 208/59 |
| 4,798,665 | 1/1989 | Humbach et al. | 208/58 |
| 4,859,309 | 8/1989 | de Vries et al. | 208/58 |
| 4,886,594 | 12/1989 | Miller | 208/216 R |
| 4,994,171 | 2/1991 | Van Helden et al. | 208/58 |
| 5,009,768 | 4/1991 | Galiasso et al. | 208/210 |
| 5,185,077 | 2/1993 | Owen | 208/61 |

FOREIGN PATENT DOCUMENTS

| | | |
|---|---|---|
| 0113283 | 7/1984 | European Pat. Off. . |
| 2277140 | 1/1976 | France . |
| 2517692 | 6/1983 | France . |
| 59-31559 | 8/1984 | Japan . |
| 61-8120 | 3/1986 | Japan . |
| 62-89793 | 4/1987 | Japan . |
| 63-258985 | 10/1988 | Japan . |
| 1-15559 | 3/1989 | Japan . |
| 1-38433 | 8/1989 | Japan . |
| 1-275693 | 11/1989 | Japan . |
| 2-289419 | 11/1990 | Japan . |

*Primary Examiner*—Paul Lieberman
*Assistant Examiner*—Patricia C. Hailey
*Attorney, Agent, or Firm*—Frishauf, Holtz, Goodman & Woodward

[57] ABSTRACT

A method of hydrotreatment of heavy hydrocarbon oil in the presence of catalysts which comprises hydrodemetallizing and hydrocracking the heavy hydrocarbon oil successively and thereafter hydrodesulfurizing and hydrodenitrogenating the treated heavy hydrocarbon oil. The hydrocracking is carried out in the presence of a catalyst comprising at least one metal or metal compound of the group VIA or the group VIII of the Periodic Table supported on a carrier comprising 10 to 90 weight % of an iron-containing aluminosilicate and 90 to 10 weight % of an inorganic oxide. Other methods of treatment of heavy hydrocarbon oil comprise the hydrotreatment in conjunction with fluid catalytic cracking and/or thermal hydrocracking. The methods provide a naphtha fraction, a kerosene fraction and a gas oil fraction which can be obtained from the heavy hydrocarbon oil efficiently with high yield.

16 Claims, 9 Drawing Sheets

METHOD OF TREATMENT OF HEAVY HYDROCARBON OIL

BACKGROUND OF THE INVENTION

1. Field of the invention

The present invention relates to a novel method of treatment of heavy hydrocarbon oil. More particularly, the present invention relates to a method of treatment of heavy hydrocarbon oil in which a naphtha fraction, a kerosene fraction and a gas oil fraction can be obtained efficiently with a high yield by hydrotreatment of the heavy hydrocarbon oil. It also relates to a method of treatment of heavy hydrocarbon oil in which a naphtha fraction, a kerosene fraction and a gas oil fraction can be obtained efficiently with a high yield by hydrotreatment, followed by fluid catalytic cracking, thermal hydrocracking with a slurry bed and further elaborate treatments of the heavy hydrocarbon oil or the vacuum distilled heavy hydrocarbon oil.

2. Description of Related Art

Various methods have been proposed for catalytic hydrotreatment of heavy hydrocarbon oil. For example, a method comprising demetallization and hydrodesulfurization was disclosed in Laid Open Japanese Patent Application Showa 62-89793. Desulfurization is the main object of this method and the method has a problem that the yield of the fraction of 343° C. or lower is low. Another method utilizing a catalyst comprising metals of the group VIA or the group VIII of the Periodic Table supported on a supporter comprising an iron-containing aluminosilicate and inorganic oxides for hydrocracking of heavy hydrocarbon oil was disclosed in Laid Open Japanese Patent Application Heisei 2-289419. A high cracking yield can be obtained by utilizing the disclosed catalyst but this method has a problem that the contents of sulfur compounds and nitrogen compounds in the fraction of 343° C. or higher are high and hence the quality of the product is inferior. A method of hydrotreating heavy hydrocarbon oil by successive demetallization, hydrodesulfurization and hydrocracking was disclosed in Laid Open Japanese Patent Application Heisei 1-275693. The main object of this method is the treatment of heavy distillates containing light cycle oil and main components of the product oil are gas ($C_1 \sim C_4$) and heavy light naphtha. This method was not intended for the treatment of heavy hydrocarbon oil containing an asphaltene fraction.

In conventional methods of catalytic hydrotreatment of heavy hydrocarbon oil directly, the heavy hydrocarbon oil is first hydrotreated with a fixed bed, a moving bed or a fluidized bed mainly for demetallization and then hydrodesulfurized or hydrotreated with a fixed bed or a fluidized bed. In the operation in which desulfurization is the main part, the reaction temperature is increased to compensate for deactivation of catalysts and this situation causes the problem that the conversion during the whole period of the operation is very low. On the other hand, in the operation in which cracking is the main part, the conversion can be increased to some degree but a problem regarding the quality of the product remains that the content of sulfur in the residue fraction is increased while deactivation of the catalyst proceeds. Moreover, the operation in which cracking is the main part requires complicated control of the processes and the desulfurization and the cracking can not be controlled independently with each other.

Recently, the price of crude oil has become high, the crude oil is becoming heavier and the demand for lighter hydrocarbons are increasing. Thus, development of technology for the cracking of residue oil comprising heavy hydrocarbon oil and for efficient production of the naphtha fraction and the gas oil fraction for transportation fuel has been desired. Flexibility of production in which the constitution of products can be varied according to the season and the location is particularly important for making a satisfactory response to the change of demand.

Various methods have been proposed to solve the problems described above. For example, a method of treating atmospheric reside by the combination of the atmospheric residue hydrodesulfurization process and the residue fluid catalytic cracking (R-FCC) was reposed. This method has a problem that the cracking in the atmospheric residue hydrodesulfurization process is insufficient and a high capacity R-FCC process is required. This method has another problem that a large amount of catalytically cracked gas oil fraction of lower value is produced which has a lower cetane number and is not suitable for direct use as transportation gas oil, such as diesel engine fuel.

In another method proposed, after separation of atmospheric residue to vacuum gas oil and vacuum residue by vacuum distillation, the vacuum gas oil and vacuum gas oil obtained by hydrotreatment of the vacuum residue are combined together and the combined oil is hydrodesulfurized and then treated by the R-FCC process. This method can treat relatively heavier oil but has a problem that the main product of the method is FCC gasoline and oils of lower value like cracked gas oil fraction and cracked residue are produced simultaneously. This method can not produce high quality gas oil fractions other than the FCC gasoline.

In still another method proposed, vacuum residue, such as the one in the preceding method, is desulfurized with a fixed bed and then treated by the R-FCC process. This method has problems that a long operation of the desulfurization with the fixed bed is difficult, that the reactivity in the R-FCC process is possibly decreased remarkably because the feed oil for the process is a product of cracking of vacuum residue and that, in addition to the FCC gasoline, a large amount of lower value oils like cracked gas oil fraction and cracked residue are produced simultaneously.

Other related methods were proposed in Japanese Patent Publications Showa 59-31559, Showa 61-8120, Heisei 1-15559, and Heisei 1-38433 and Laid Open Japanese Patent Application Showa 63-258985. These methods all have difficult problems, such as treatment of asphaltene, complicated processes and the like.

Thus, it has been the actual situation that a satisfactory method of efficiently producing the naphtha fraction and the light oil fraction for transportation fuel by the cracking of residue can not be found and that such a method has been urgently desired.

SUMMARY OF THE INVENTION

An object of the present invention is to provide a method of utilizing heavy hydrocarbon oil efficiently as the resource of the naphtha fraction and the kerosene and gas oil fraction which are useful as transportation fuel.

Another object of the invention is to provide a method of treatment of heavy hydrocarbon oil which can realize stable operation with simple control.

Still another object of the invention is to provide a method of treatment of heavy hydrocarbon oil by which the naphtha fraction and the kerosene and gas oil fraction can be obtained efficiently with high yields.

The present invention provides a method of hydrotreatment of heavy hydrocarbon oil in the presence of catalysts which comprises hydrodemetallizing and hydrocracking the heavy hydrocarbon oil successively and thereafter hydrodesulfurizing and hydrodenitrogenting the treated heavy hydrocarbon oil (Embodiment 1).

The present invention also provides a method of treatment of heavy hydrocarbon oil which comprises hydrotreating the heavy hydrocarbon oil in the presence of catalysts as described above, fractionating the hydrotreated heavy hydrocarbon oil by distillation and fluid catalytically cracking the residue obtained by the distillation (Embodiment 2).

The present invention further provides a method of treatment of heavy hydrocarbon oil which comprises hydrotreating the heavy hydrocarbon oil in the presence of catalysts as described above, separating the hydrotreated heavy hydrocarbon oil to vacuum gas oil I and vacuum residue I by atmospheric and vacuum distillations, thermal hydrocracking the vacuum residue I with a slurry bed, separating the thermal hydrocracked oil to vacuum gas oil II and vacuum residue II by atmospheric and vacuum distillations and fluid catalytically cracking the vacuum gas oil II and the vacuum gas oil I obtained before (Embodiment 3). The invention also provides a method of treatment of heavy hydrocarbon oil which comprises fluid catalytically cracking the vacuum gas oil II, the vacuum gas oil I obtained before and at least a part of the vacuum residue II (Improved Embodiment 3).

The present invention also provides a method of treatment of heavy hydrocarbon oil which comprises hydrotreating the heavy hydrocarbon oil in the presence of catalysts as described above, separating the hydrotreated heavy hydrocarbon oil to vacuum gas oil I and vacuum residue I by atmospheric and vacuum distillations, thermal hydrocracking the vacuum residue I with a slurry bed, separating the thermal hydrocracked oil to vacuum gas oil II and vacuum residue II by atmospheric and vacuum distillations and recycling the vacuum gas oil II and the vacuum gas oil I obtained before to a stage before or after the hydrodemetallization (Embodiment 4). The invention also provides a method of treatment of heavy hydrocarbon oil which comprises recycling the vacuum gas oil II, the vacuum gas oil and at least a part of the vacuum residue II to a stage before or after the hydrodemetallization in the hydrotreatment (Improved Embodiment 4).

The present invention still further provides a method of treatment of heavy hydrocarbon oil which comprises separating the heavy hydrocarbon oil to vacuum gas oil and vacuum residue by vacuum distillation, thermal hydrocracking the vacuum residue with a slurry bed, separating the thermal hydrocracked vacuum residue to a light fraction and a residue fraction by fractionation and hydrotreating the residue fraction and the vacuum gas oil in the presence of catalysts by the method described above (Embodiment 5). The invention also provides a method of treatment of heavy hydrocarbon oil which comprises recycling at least a part of the residue fraction obtained by the fractionation to a stage before or after the hydrodemetallization in the hydrotreatment (Improved Embodiment 5).

BRIEF DESCRIPTION OF THE DRAWINGS

The invention will be described with reference to the accompanying drawings, wherein.

Figure 1:
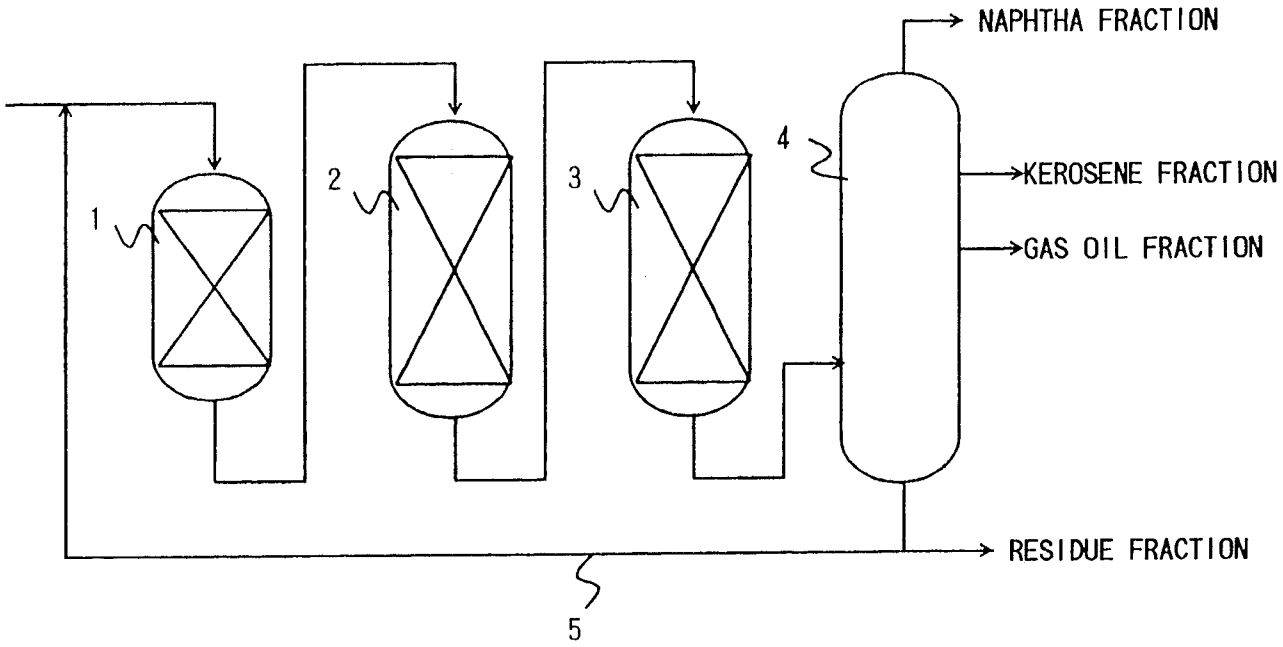
FIG. 1 is a schematic drawing which shows an example of the basic arrangement of units to practice the Embodiment 1.

The numbers and characters in the figures have the meanings as listed in the following:

1: a hydrodemetallization reactor
2: a hydrocracking reactor
3: a hydrodesulfurization and hydrodenitrogenation reactor
4: an atmospheric distillation tower
5: a recycling line
6: a fluid catalytic cracking reactor
7: a riser
8: a regenerator
9: an atmospheric distillation tower
A: hydrotreatment
B: fluid catalytic cracking
C: thermal hydrocracking with a slurry bed
D: atmospheric distillation
$D_1$: vacuum distillation
$D_2$: atmospheric and vacuum distillation

DESCRIPTION OF PREFERRED EMBODIMENTS

The feed oil which is treated by the method of the invention is heavy hydrocarbon oil of various kinds, such as atmospheric residue and vacuum residue from crude oil, heavy gas oil, solvent deasphalted oil, demetallized oil, catalytic cracked oil, visbreaking oil, tar sand oil, shell oil and the like.

General properties of the heavy hydrocarbon oil are as shown in the following.

| | |
|---|---|
| boiling point | content of the fraction of 343° C. or higher: 90 weight % or more |
| metal content | 20~150 ppm |
| sulfur content | 1.0~5.0 weight % |
| carbon residue | 2~18 weight % |
| asphaltene concentration | 1~10 weight % |

Embodiments described above will be explained first.

The heavy hydrocarbon oil is hydrodemetallized in the hydrodemetallization reactor which is the first stage of the hydrotreatment. For the hydrodemetallization, the heavy hydrocarbon oil and hydrogen are mixed and the mixture is sent to the hydrodemetallization reactor. The hydrodemetallization reactor is operated in one or more reactors. When it is operated with the fixed bed, every reactor is divided into more than one catalyst beds and fluid is introduced into every catalyst bed to cool the reactants.

The catalyst utilized in the hydrodemetallization may be selected from any kinds of commercially available demetallization catalysts which comprise compounds of one or more kinds of metal or metal compound (occasionally called simply metals, including both of metals and metal compounds) of the group VIB and the group VIII of the Periodic Table supported on inorganic porous oxides, such as alumina, silica, silica-alumina or zeolite.

The conditions of the hydrodemetallization are as following: the reaction temperature, 300°to 450° C.; the partial pressure of hydrogen, 30 to 200 kg/cm$^2$G; the hydrogen/oil ratio, 300 to 2,000 Nm$^3$/kl; and LHSV (liquid hour space velocity), 0.1 to 10 hr$^{-1}$; and preferably, the reaction temperature, 360° to 420° C.; the partial pressure of hydrogen, 100 to 180 kg/cm$^2$G; the hydrogen/oil ratio, 500 to 1,000 Nm$^3$/kl; and LHSV, 0.3 to 5.0 hr$^{-1}$.

The value of the ratio, which is the composition ratio of aromatic components and saturated components (aromatic/saturate) in the fraction of 343° C. or higher of the oil treated by the hydrodemetallization divided by the corresponding composition ratio in the feed oil (the composition ratio of the oil treated by the hydrodemetallization process/the composition ratio of the feed oil), is preferably 0.2 or more, more preferably 0.4 or more. The reaction in the hydrocracking by which the hydrodemetallized heavy hydrocarbon oil be treated is promoted in this condition.

The oil finished the treatment of the hydrodemetallization is next sent to the hydrocracking reactor. The hydrocracking reactor is operated in one or more reactors. When it is operated with the fixed bed, every reactor is divided into more than one catalyst beds and fluid is introduced into every catalyst bed to cool the reactants.

As the catalyst for the hydrocracking, catalysts prepared by the methods disclosed in Japanese Patent Publications Showa 60-49131, Showa 61-24433 and Heisei 3-21484 may be utilized. These catalysts comprise oxides of one or more kinds of metal of the group VIB and the group VIII of the Periodic Table supported on a support comprising 20 to 80 weight % of an iron-containing zeolite and 80 to 20 weight % of inorganic oxides. Catalysts prepared by the method disclosed in Laid Open Japanese Patent Application Heisei 2-289419, which comprises oxides of one or more kinds of metal of the group VIB and the group VIII of the Periodic Table supported on a support comprising 10 to 90 weight % of an iron-containing zeolite and 90 to 10 weight % of inorganic oxides, may also be utilized. The iron-containing zeolite prepared according to the latter method by treating the steaming zeolite with an aqueous solution of iron salts is very effective for enhancing the yield of the fraction of 343° C. or lower by the cracking of the fraction of 343° C. or higher. As the metal of the group VIB of the Periodic Table, molybdenum and tungsten are preferred. As the metal of the group VIII of the Periodic Table, nickel and cobalt are preferred.

The conditions of the hydrocracking are as following: the reaction temperature, 300° to 450° C.; the partial pressure of hydrogen, 30 to 200 kg/cm$^2$G; the hydrogen/oil ratio, 300 to 2,000 Nm$^3$/kl; and LHSV, 0.1 to 2.0 hr$^{-1}$; and preferably, the reaction temperature, 380° to 420° C.; the partial pressure of hydrogen, 100 to 180 kg/cm$^2$G; the hydrogen/oil ratio, 500 to 1,000 Nm$^3$/kl; and LHSV, 0.2 to 1.0 hr$^{-1}$.

As the result of the hydrocracking, the fraction of 343° C. or higher is cracked to form the fraction of 343° C. or lower and the naphtha fraction and the kerosene and gas oil fraction having high quality can be obtained in high yields.

The oil treated by the hydrodemetallization and the hydrocracking successively and coming out of the hydrocracking process is next sent to the hydrodesulfurization and hydrodenitrogenation reactor. The hydrodesulfurization and hydrodenitrogenation reactor is operated in one or more reactors. When it is operated with the fixed bed, every reactor is divided into more than one catalyst beds and fluid is introduced into every catalyst bed to cool the reactants.

As the catalyst in the hydrodesulfurization and hydrodenitrogenation, catalysts generally used for conventional atmospheric residue hydrodesulfurization units can be utilized. An example of such catalysts is a catalyst comprising one or more kinds of metals selected from metals of the group VIB of the Periodic Table and metals of the group VIII of the Periodic Table supported on a support, such as alumina, silica, zeolite or mixtures thereof. Examples of the metal of the group VIB of the Periodic Table are molybdenum and tungsten. Examples of the metal of the group VIII of the Periodic Table are cobalt and nickel. Particular examples of the metals are cobalt-molybdenum and nickel-molybdenum.

The conditions of the hydrodesulfurization and hydrogenitrogenation are as following: the reaction temperature, 300° to 450° C.; the partial pressure of hydrogen, 30 to 200 kg/cm$^2$G; the hydrogen/oil ratio, 300 to 2,000 Nm$^3$/kl; and LHSV, 0.1 to 2.0 hr$^{-1}$; and preferably, the reaction temperature, 360° to 420° C.; the partial pressure of hydrogen, 100 to 180 kg/cm$^2$G; the hydrogen/oil ratio, 500 to 1,000 Nm$^3$/kl; and LHSV, 0.1 to 0.5 hr$^{-1}$.

As the result of the hydrodesulfurization and hydrodenitrogenation, the quality of the fraction of 343° C. or higher is improved.

In the hydrodemetallization treatment, the hydrocracking treatment and the hydrodesulfurization and hydrodenitrogenation treatment, 20 to 70 weight % of the fraction of 343° C. or higher contained in the feed oil can be cracked to form the fraction of 343° C or lower by varying the temperature at the inlet of each process in a suitable manner within the range from 300° to 420° C.

The sulfur content, the nitrogen content and the carbon residue, particularly the sulfur content among them, in the fraction of 343° C. or higher can also be controlled within the range from 0.1 to 2.0 weight %.

The oil coming out of the hydrotreatment after finishing the catalytic hydrotreatment including the hydrodemetallization treatment, the hydrocracking treatment and the hydrodesulfurization and hydrodenitrogenation treatment is next sent to the separation process according to the general method and separated to the gas fraction and the liquid fraction by the treatment in more than one separation units. The gas fraction is subject to the treatment of removing hydrogen sulfide, ammonia and the like and to the treatment of enhancing purity of hydrogen and then recycled to the reaction process in combination with make up hydrogen gas.

The liquid fraction separated in the separation process is introduced into the distillation process and fractionated (separated) to fractions according to the general method. For example, the liquid fraction can be separated at the atmospheric pressure, by the atmospheric distillation, to the naphtha fraction, the kerosene fraction, gas oil fraction and the residue by setting the cutting temperature of the naphtha fraction at 145° to 190° C., the cutting temperature of the kerosene fraction at 235° to 265° C. and the cutting temperature of the gas oil fraction at 343° to 380° C. and by taking the fraction of 380° C. or higher as the residue. The fractionation can be made by the vacuum distillation as well.

A part of the oil coming out of the hydrotreatment or the residue separated by the distillation may be recycled to the reaction process depending on the condition of the operation of the processes.

FIG. 1 shows an example of the basic construction of units to practice the Invention 1. The heavy hydrocarbon oil is hydrodemetallized at 1, hydrocracked at 2, and hydrodesulfurized and hydrodenitrogenated at 3, all of which constitute the hydrotreatment process. The oil coming out of the hydrotreatment process after finishing the hydrotreatment is separated to the naphtha fraction, the kerosene fraction, the gas oil fraction and the residue by the fractionation at the atmospheric distillation tower 4. A part of the oil coming out of the hydrotreatment process or the residue separated by the distillation is recycled to the hydrotreatment process via the recycling line 5.

The present invention also provides a method of obtaining the naphtha fraction and the kerosene and gas oil fraction more efficiently by treating with the fluid catalytic cracking, the thermal hydrocracking with the slurry bed and other treatments in addition to the hydrotreatment.

Thus, Embodiment 2 of the present invention provides a method of treatment of heavy hydrocarbon oil comprising hydrotreating the heavy hydrocarbon oil and then fluid catalytically cracking the residue separated from the reaction product.

In Embodiment 2, the residue separated by the distillation after the hydrotreatment is fluid catalytically cracked in the fluid catalytic cracking process with or without mixing of a part of the gas oil fraction separated by the distillation.

General properties of the heavy hydrocarbon oil are as shown in the following.

| | |
|---|---|
| specific gravity | 0.78~0.95 |
| kinematic viscosity | 1.8~20 (100° C.) cSt |
| sulfur content | 0.01~2.3 weight % |

The fluid catalytic cracking unit is constituted with, for example, a reactor attached with a riser and a regenerator. The residue is introduced into the unit with the regenerated catalyst from the regenerator. Cracking reaction of the residue is made in the riser. The reaction products of the cracking and the catalyst are separated in the reactor. The catalyst separated in the reactor is steam stripped and then sent to the regenerator. In the regenerator, the catalyst is regenerated by burning cokes and the catalyst is reused in the fluid catalytic cracking.

Examples of the supporter of the catalyst utilized in the fluid catalytic cracking process are silica, alumina, silica-alumina, aluminamagnesia, silica-titania, alumina-titania, various kinds of clay, various kinds of crystalline aluminosilicate and mixtures thereof.

The condition of the fluid catalytic cracking is varied depending on the specification of the apparatuses, properties of the residue to be processed and other like factors and can be suitably selected according to the situation. For example, the temperature at the outlet of the riser is 480° to 530° C. and the catalyst/oil ratio is 4.0 to 6.5 weight/weight and, preferably, the temperature at the outlet of the riser is 500° to 525° C. and the catalyst/oil ratio is 4.3 to 5.9 weight/weight.

The reaction product of the cracking separated from the catalyst in the reactor of the fluid catalytic cracking unit is sent to the distillation process and separated to fractions according to the general method as described above.

For example, the reaction product can be separated at atmospheric pressure, by the atmospheric distillation, to the gasoline fraction, gas oil fraction and the residue by setting the cutting temperature of the gasoline fraction at $C_5$ to 180° C. and the cutting temperature of the gas oil fraction at 180° to 360° C. and by taking the fraction of 360° C. or higher as the residue. The fractionation can be made by the vacuum distillation as well.

Figure 2:
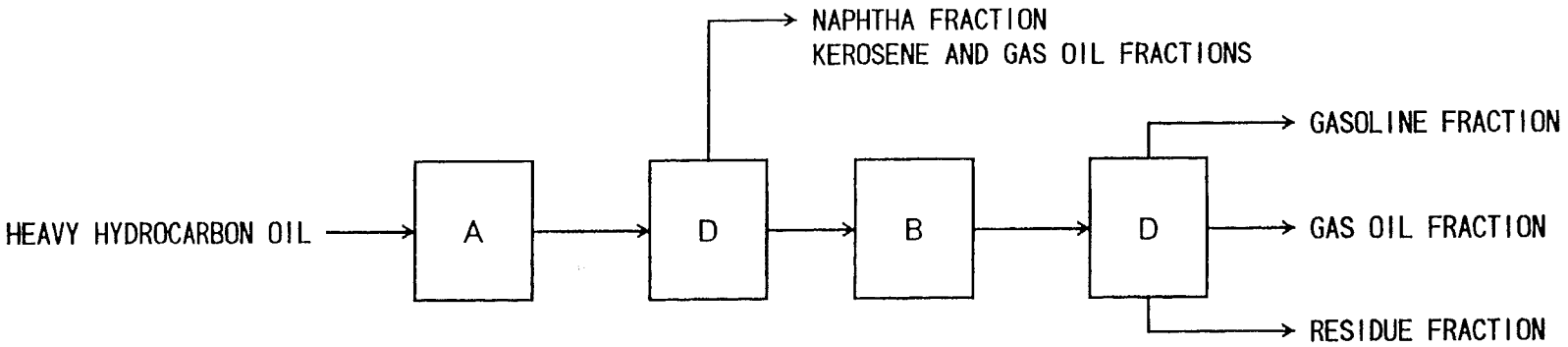
FIG. 2 is a schematic drawing explaining the basic concept of Embodiment 2.
Figure 3:
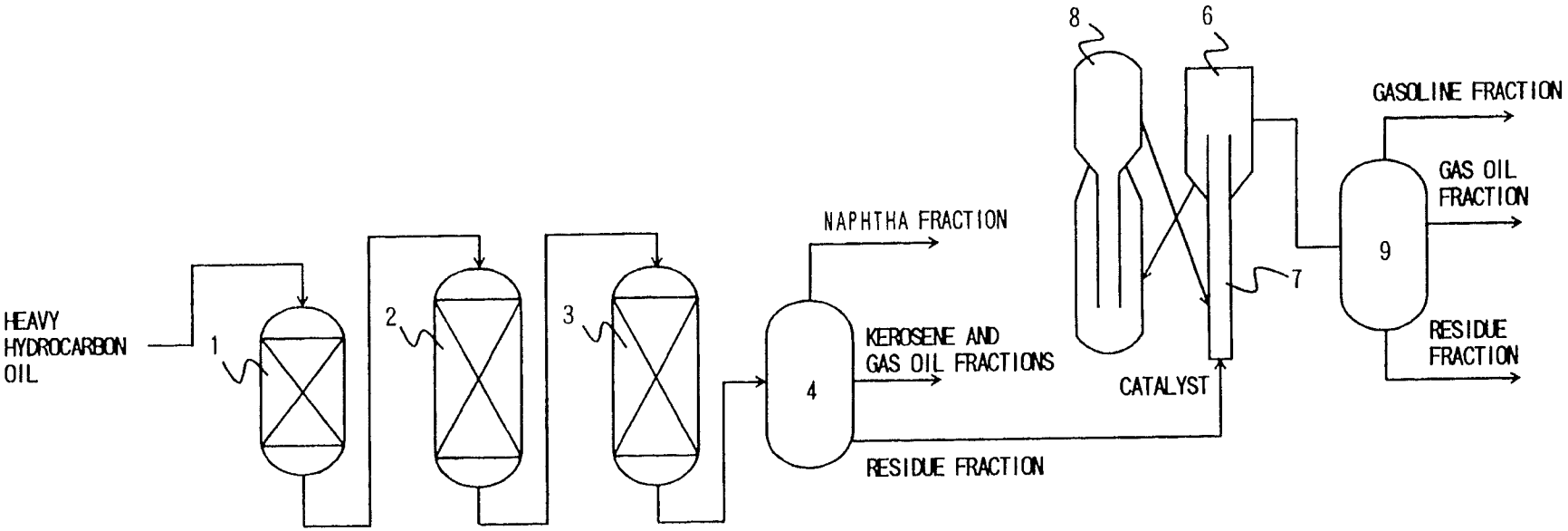
FIG. 3 shows an example of the basic construction of units to practice the Embodiment 2.

FIG. 2 is a drawing explaining the basic concept of Embodiment 2. FIG. 3 shows an example of the basic construction of units to practice the Embodiment 2. The heavy hydrocarbon oil is treated with the hydrotreatment by the hydrodemetallization reactor 1, hydrocracking reactor 2, and hydrodesulfurization and hydrodenitrogenation reactor 3, all of which constitute the hydrotreatment process. The oil coming out of the hydrotreatment process after finishing the hydrotreatment is separated to the naphtha fraction, the kerosene fraction, the gas oil fraction and the residue by the fractionation at the atmospheric distillation tower 4. The residue separated by the atmospheric distillation in the atmospheric distillation tower 4 is treated with the fluid catalytic cracking in the reactor 6 attached with the riser 7. The used catalyst in the fluid catalytic cracking in the reactor is regenerated in the regenerator 8 and reused in the fluid catalytic cracking. After the fluid catalytic cracking process, the reaction product of the cracking is separated to fractions in the atmospheric distillation tower 9 by the similar process in the distillation tower 4.

Embodiment 3 of the present invention provides a method of treatment of heavy hydrocarbon oil comprising hydrotreating the heavy hydrocarbon oil, thermal hydrocracking the reaction product with the slurry bed and then fluid catalytically cracking.

In Embodiment 3, after the hydrotreatment, the hydrotreated oil is introduced into the separation process according to the general method and separated to the gas fraction and the liquid fraction by treating in more than one separation units. The gas fraction is subject to the treatment of removing hydrogen sulfide, ammonia and the like and to the treatment of enhancing purity of hydrogen and then recycled to the reaction process in combination with make up hydrogen gas.

The liquid fraction separated in the separation process is sent to the distillation process and separated to fractions according to the general method. For example, the liquid fraction can be separated at atmospheric pressure, by the atmospheric distillation, to the naphtha fraction, the kerosene fraction, the gas oil fraction and the residue (hydrotreatment residue) by setting the cutting temperature of the naphtha fraction at 145° to 190° C., the cutting temperature of the kerosene fraction at 235° to 265° C. and the cutting temperature of the gas oil fraction at 343° to 380° C. and by taking the fraction of 380° C. or higher as the residue. The naphtha fraction is utilized as the feed oil in the catalytic reforming to prepare reformed gasoline having high octane numbers.

In Embodiment 3, the hydrotreatment residue obtained by the atmospheric distillation is separated to the vacuum gas oil I (VGO) and the vacuum residue I (VR) by the the vacuum distillation.

The residue I separated in the vacuum distillation is mixed with hydrogen and thermal hydrocracked with the slurry bed in the presence of the catalyst. Detailed conditions of the reaction of the thermal hydrocracking will be described later in the description of Embodiment 4. The treated oil is separated to the gas fraction and the liquid fraction by the same method as before. The liquid fraction separated herein is distilled by the atmospheric distillation and then by the vacuum distillation by the same method as before and separated to the vacuum gas oil II and the vacuum residue II.

The vacuum gas oil II thus produced after the thermal hydrocracking and separated by the vacuum distillation in the vacuum distillation tower is combined with the vacuum gas oil I produced before ad fluid catalytically cracked by the fluid catalytic cracking process by the same method as before.

In the Improved Embodiment 3, the thermally hydrocracked oil in the thermal hydrocracking process is separated to the vacuum gas oil II and the vacuum residue II by the atmospheric distillation and by the vacuum distillation. The vacuum gas oil II is combined with the vacuum gas oil I and at least a part (a part or all) of the vacuum residue II and the combined oil is fluid catalytically cracked by the fluid catalytic cracking process by the same method as before.

The fluid catalytic cracking process is operated in the same way as described before in the unit constituted, for example, with the reactor attached with the riser and the regenerator. The fraction comprising the vacuum gas oil II and the vacuum gas oil I or the vacuum gas oil II, the vacuum gas oil I and the vacuum residue II is introduced into the unit together with the regenerated catalyst from the regenerator. The cracking reaction is made in the riser and the reaction products of the cracking and the catalyst are separated in the reactor. The catalyst separated in the reactor is steam stripped and then sent to the regenerator. In the regenerator, the catalyst is regenerated by burning cokes and the catalyst is reused in the fluid catalytic cracking.

The reaction product of the cracking separated in the reactor of the fluid catalytic cracking process is sent to the distillation process and separated to fractions according to the generally practiced method like the preceding similar processes. For example, the reaction product can be separated at atmospheric pressure, by the atmospheric distillation, to the gasoline fraction, the gas oil fraction and the residue by setting the cutting temperature of the gasoline fraction at $C_5$ to 180° C. and the cutting temperature of the gas oil fraction at 180° to 360° C. and by taking the fraction of 360° C. or higher as the residue.

Figure 4:
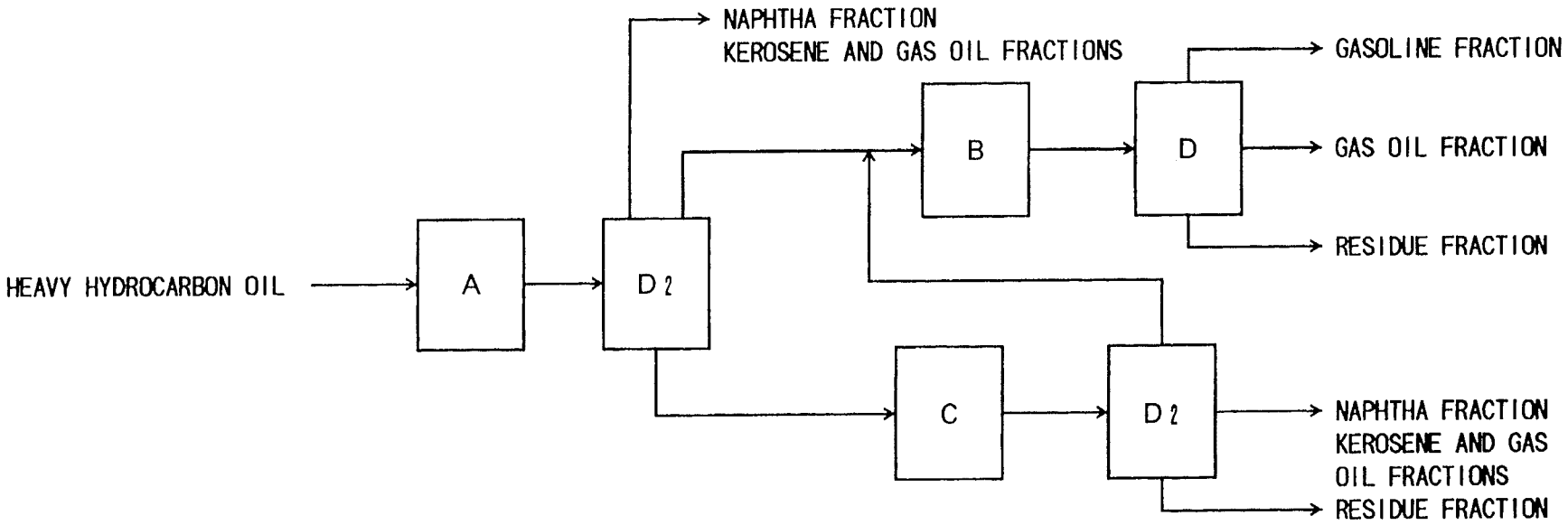
FIG. 4 is a schematic drawing explaining the basic concept of Embodiment 3.
Figure 5:
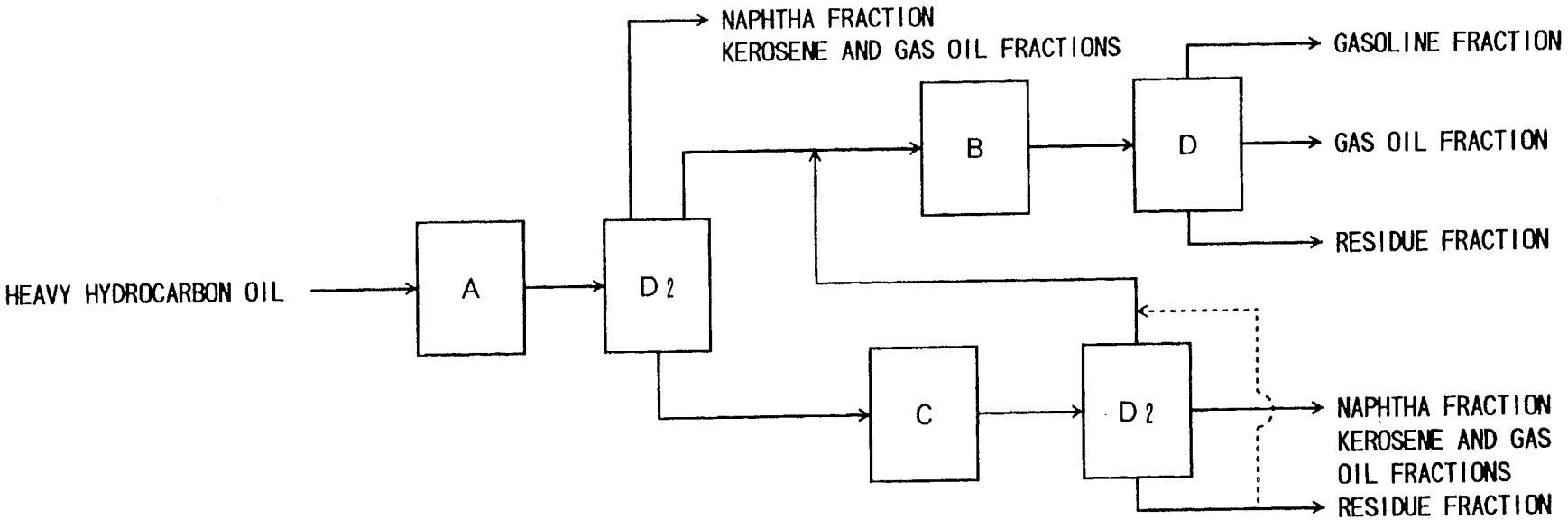
FIG. 5 is a drawing explaining the basic concept of Improved Invention 3.

FIG. 4 is a drawing explaining the basic concept of Embodiment 3. FIG. 5 is a drawing explaining the basic concept of Improved Embodiment 3.

The flow rate of oils in each process is different depending on the situation of the operation but generally in the following range: the flow rate of the vacuum gas oil I which is obtained by the atmospheric or vacuum distillation of the hydrotreated oil prepared by the hydrotreatment followed by fractionation is 6 to 56 volume % based on the flow rate of the charged heavy hydrocarbon oil and 98 to 23 volume % based on the flow rate in the fluid catalytic cracking process. The flow rate of the vacuum gas oil II which is obtained by the atmospheric distillation and vacuum distillation of the thermally hydrocracked oil prepared by the thermal hydrocracking of the vacuum residue I with the slurry bed is 2 to 77 volume % (including the vacuum residue II in some cases) based on the flow rate in the fluid catalytic cracking process.

Embodiment 4 of the present invention provides a method of treatment of heavy hydrocarbon oil comprising hydrotreating the heavy hydrocarbon oil, thermal hydrocracking the reaction product with the slurry bed and other treatments.

Embodiment 4 provides the method of treatment of heavy hydrocarbon oil comprising hydrotreating the heavy hydrocarbon oil, separating the hydrotreated oil obtained in the hydrotreatment to vacuum gas oil I and vacuum residue I by the atmospheric and vacuum distillations, thermal hydrocracking the vacuum residue with the slurry bed, separating the product of the thermal hydrocracking to vacuum gas oil II and vacuum residue II by the atmospheric and vacuum distillations and recycling the vacuum gas oil II and the vacuum gas oil I by adding them to the heavy hydrocarbon oil.

Improved Embodiment 4 provides the method of treatment of heavy hydrocarbon oil comprising hydrotreating the heavy hydrocarbon oil, separating the hydrotreated oil obtained in the hydrotreatment to vacuum gas oil I and vacuum residue I by the atmospheric and vacuum distillations, thermal hydrocracking the vacuum residue with the slurry bed, separating the product of the thermal hydrocracking to vacuum gas oil II and vacuum residue II by the atmospheric and vacuum distillations and recycling the vacuum gas oil II, the vacuum gas oil I and at least a part of the vacuum residue II by adding them to the heavy hydrocarbon oil.

In Embodiment 4 and Improved Embodiment 4, the heavy hydrocarbon oil is combined with the vacuum gas oil I and the vacuum gas oil II or the vacuum gas oil I, the vacuum gas oil II and at least a part (a part or all) of vacuum residue II, mixed with hydrogen and treated with the hydrotreatment and the thermal hydrocracking in the presence of catalysts.

The vacuum gas oil I and the vacuum gas oil II or the vacuum gas oil I, the vacuum gas oil II and the vacuum residue II can be hydrotreated together with the heavy hydrocarbon oil in the following way: the heavy hydrocarbon oil is first hydrotreated and thermally hydrocracked and, when the vacuum gas oil I, the vacuum gas oil II and the vacuum residue II begin to be formed and separated by the distillation, the vacuum gas oil I, the vacuum gas oil II and the vacuum residue II are recycled to a stage before or after the hydrodemetallization in the hydrotreatment process.

General properties of the heavy hydrocarbon oil mixed with the vacuum gas oil I and the vacuum gas oil II o the vacuum gas oil I, the vacuum gas oil II and the vacuum residue II in a stage before the hydrodemetallization in the hydrotreatment process are as following:

| | |
|---|---|
| specific gravity | 0.90~1.01 |
| kinematic viscosity (50° C.) | 50~15,000 cSt |
| sulfur content | 0.5~5.0 weight % |
| nitrogen content | 300~4,000 ppm |
| carbon residue | 20 weight % or less |
| vanadium content | 250 ppm or less |
| nickel content | 250 ppm or less |

The catalyst utilized in the thermal hydrocracking with the fixed bed comprises oxides of one or more kinds of metals of the group VIB and the group VIII of the Periodic Table supported on a supporter comprising alumina, silica, silica-alumina, silica-alumina-magnesia, alumina-titania and the like. The metal of the group VIB of the Periodic Table is preferably molybdenum or tungsten. The metal of group VIII of the Periodic Table is preferably nickel or cobalt. The metals can be used as a combination, such as nickel-molybdenum, cobalt-molybdenum, nickel-tungsten, cobalt-tungsten and vanadium-nickel. The diameter of the catalyst is generally in the range from 4 to 150 μm. An example of such catalyst is a catalyst of a diameter of 4 to 150 μm comprising 0.5 to 5 weight % of nickel and 1 to 12 weight % of molybdenum supported on a support of silica-alumina. The catalyst can be extracted as a slurry containing the catalyst particles and the treated oil, regenerated by partial oxidation and used repeatedly.

Used catalysts of the atmospheric residue hydrodesulfurization and used catalysts of the fluid catalytic cracking may be utilized as the catalyst in the thermal hydrocracking as well.

The conditions of the thermal hydrocracking are as following: the reaction temperature, 370° to 480° C.; the partial pressure of hydrogen, 30 to 200 kg/cm$^2$; LHSV, 0.1 to 2.0 hr$^{-1}$; and the catalyst/oil ratio, 0.01 to 0.30 weight/weight; and preferably, the reaction temperature, 420°~450° C.; the partial pressure of hydrogen, 60 to 80 kg/cm$^2$; LHSV, 0.2 to 1.0 hr$^{-1}$; and the catalyst/oil ratio, 0.03 to 0.18 weight/weight.

In Embodiment 4 and Improved Embodiment 4, the heavy hydrocarbon oil mixed with the vacuum gas oil I and the vacuum gas oil II or with the vacuum gas oil I, the vacuum gas oil II and the vacuum residue II is hydrotreated as the first treatment. The hydrotreated oil coming out of the reaction process after finishing the hydrotreatment is introduced to the separation process and separated to the gas fraction and the liquid fraction according to the general method as described above.

The liquid fraction separated in the separation process is introduced into the distillation process and separated to each fractions according to the general method. The hydrotreated residue obtained by the atmospheric distillation is then distilled by the vacuum distillation process and separated to the vacuum gas oil I (VGO) and the vacuum residue I (VR).

The vacuum residue I separated by the vacuum distillation process is mixed with hydrogen and thermally hydrocracked with the slurry bed in the presence of the catalyst. The product of the thermal hydrocracking is separated to the gas fraction and the liquid fraction in the separation process and the liquid fraction thus separated is, in turn, separated to the vacuum gas oil II and the vacuum residue II by the atmospheric and vacuum distillations.

General properties of the vacuum residue I which is treated with the thermal hydrocracking process is as following:

| | |
|---|---|
| specific gravity | 0.95~1.03 |
| kinematic viscosity | 200 (50° C.)~2,500 (100° C.) cSt |
| sulfur content | 0.5~6.0 weight % |
| nitrogen content | 1,500~4,500 ppm |
| carbon residue | 20 weight % or less |
| vanadium content | 250 ppm or less |
| nickel content | 250 ppm or less |

The vacuum gas oil II separated in the vacuum distillation tower is combined with the vacuum gas oil I obtained before and added to the heavy hydrocarbon oil. In the improved method, the vacuum gas oil II is combined with at least a part (a part or all) of the vacuum residue II and the vacuum gas oil I obtained before and added to the heavy hydrocarbon oil.

The purpose of recycling the vacuum gas oil I and the vacuum gas oil II or the vacuum gas oil I, the vacuum gas oil II and the vacuum residue II by adding to the heavy hydrocarbon oil is to reduce the formation of the residues and to increase the production of high quality naphtha, kerosene and gas oil as the scheme of treating the heavy oil.

The reaction product coming out of the thermal hydrocracking process is transferred to the distillation process and separated to each fractions according to the general method.

Figure 6:
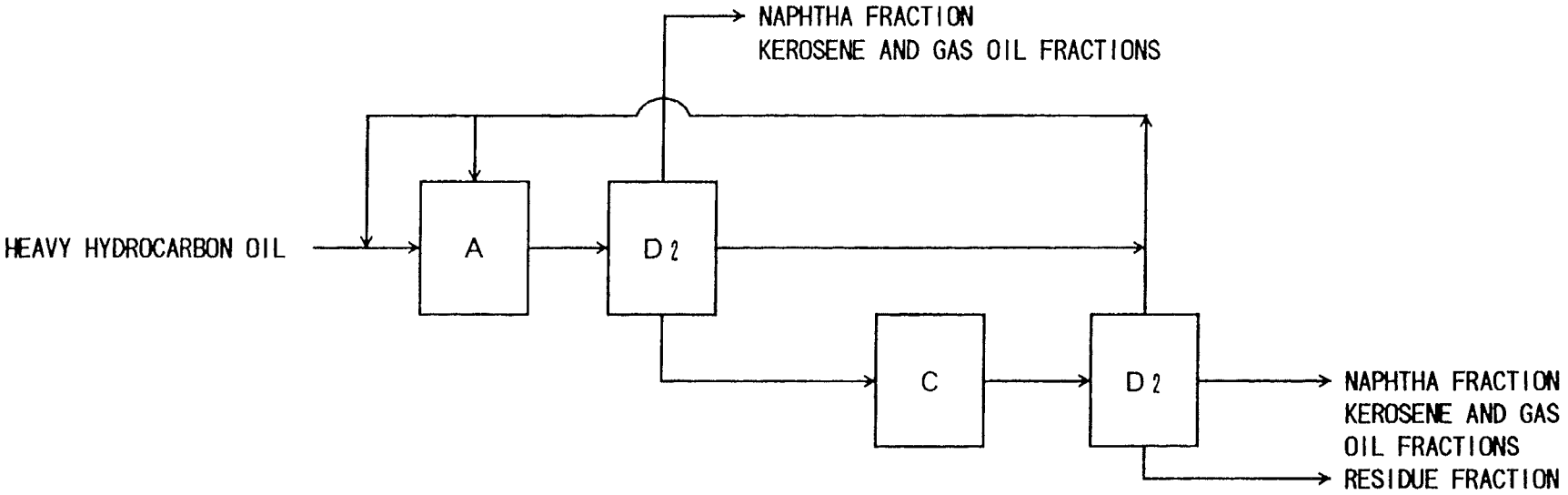
FIG. 6 is a drawing explaining the basic concept of Invention 4.
Figure 7:
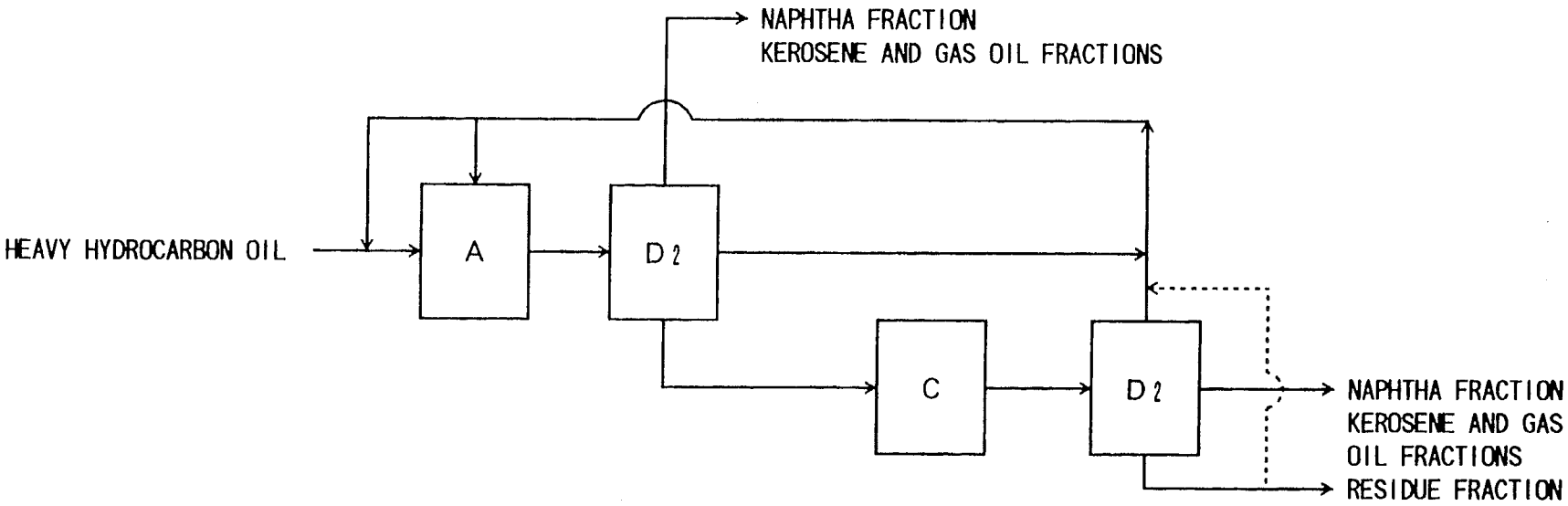
FIG. 7 is a schematic drawing explaining the basic concept of Improved Embodiment 4.

FIG. 6 is a drawing explaining the basic concept of Embodiment 4. FIG. 7 is a drawing explaining the basic concept of Improved Embodiment 4.

The flow rate of oils based on the flow rate of the feed heavy hydrocarbon oil in each process is different depending on the situation of the operation but generally in the following range: the hydrotreated oil which is obtained by the hydrotreatment followed by the fractionation, 33 to 215 volume %; the vacuum gas oil I which is obtained by vacuum distillation of the hydrotreated oil, 5 to 175 volume %; the vacuum residue I, 5 to 175 volume %; the vacuum gas oil II which is obtained by thermal hydrocracking with the slurry bed of the vacuum residue I, followed by the vacuum distillation of the thermally hydrocracked oil (sometimes including vacuum residue II), 0.5 to 110 volume %; and the vacuum gas oil I and the vacuum gas oil II which are recycled to a stage before or after the hydrodemetallization, 5~205 volume %.

Embodiment 5 and Improved Embodiment 5 of the present invention provides a method of treatment of heavy hydrocarbon oil comprising the vacuum distillation, hydrotreatment and the thermal hydrocracking with the slurry bed and other treatments of the heavy hydrocarbon oil In Embodiment 5, the heavy hydrocarbon oil is separated to the vacuum gas oil and the vacuum residue by the vacuum distillation. The vacuum residue is then thermal hydrocracked with the slurry bed and the thermal hydrocracked oil is fractionated to the light fraction and the residue. The residue is hydrotreated in combination with the vacuum gas oil obtained before.

The heavy hydrocarbon oil is distilled in vacuum and separated to the vacuum gas oil and the vacuum residue as the first step in this method.

The vacuum residue thus obtained is mixed with hydrogen and thermally hydrocracked with the slurry bed in the presence of the catalyst. The thermally hydrocracked oil is then introduced into the separation process according to the general method and separated to the gas fraction and the liquid fraction.

The liquid fraction separated in the separation process is sent to the distillation process (the atmospheric distillation or the combination of the atmospheric distillation and the vacuum distillation) and separated to the light fraction and the residue according to the generally practiced method. For example, the liquid fraction can be separated at the atmospheric pressure, by the atmospheric distillation, to the naphtha fraction, kerosene fraction, the gas oil fraction and the residue by setting the cutting temperature of the naphtha fraction at 145° to 190° C., the cutting temperature of the kerosene fraction at 235° to 265° C. and the cutting temperature of the gas oil fraction at 343° to 380° C. and by taking the fraction of 380° C. or higher as the residue. The naphtha fraction is utilized as the feed oil in the catalytic reforming process to prepare reformed gasoline having high octane numbers.

In this method, the residue obtained by the distillation is hydrotreated in combination with the vacuum gas oil which is obtained by the vacuum distillation of the heavy hydrocarbon oil in the vacuum distillation process.

The hydrotreated oil coming out of the reaction process after finishing the hydrotreatment is introduced to the separation process according to the general method and separated to the gas fraction and the liquid fraction.

The liquid fraction separated in the separation process is sent to the distillation process and separated to the fractions according to the generally practiced method. For example, the liquid fraction can be separated at the atmospheric pressure, by the atmospheric distillation, to the naphtha fraction, the kerosene fraction, the gas oil fraction and the residue by setting the cutting temperature of the naphtha fraction at 145° to 190° C., the cutting temperature of the kerosene fraction at 235° to 265° C. and the cutting temperature of the gas oil fraction at 343° to 380° C. and by taking the fraction of 380° C. or higher as the residue. The naphtha fraction is utilized as the feed oil in the catalytic reforming process to prepare reformed gasoline having high octane numbers.

Improved Embodiment 5 comprises the method of treatment of heavy hydrocarbon in which at least a part (a part or all) of the residue obtained by the hydrotreatment of the oil followed by the fractionation is recycled to a stage before or after the hydrodemetallization in the hydrotreatment process and the combined fraction is hydrotreated as described before.

Figure 8:
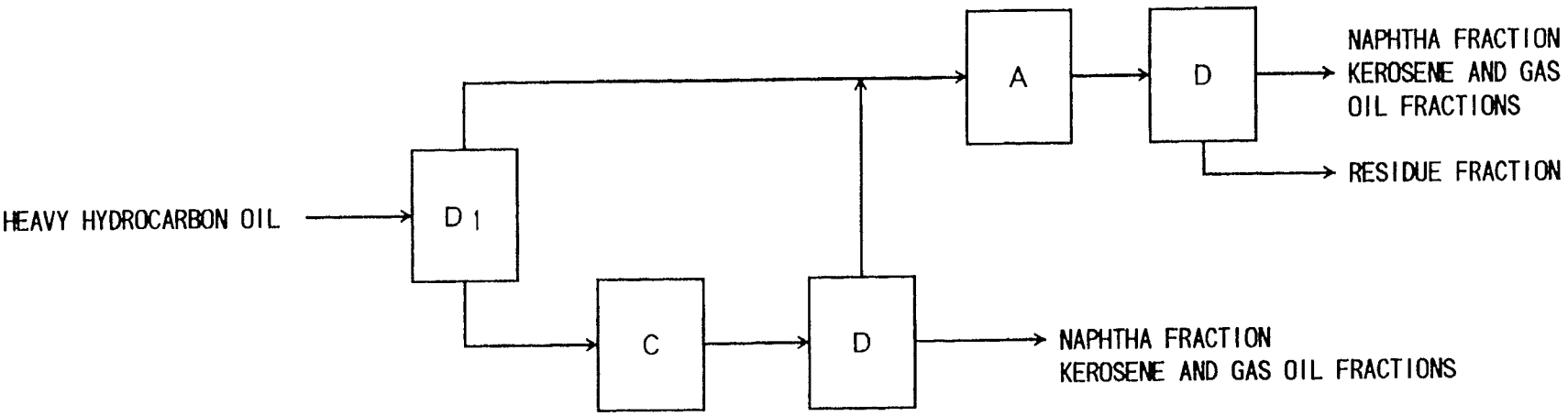
FIG. 8 is a drawing explaining the basic concept of Embodiment 5.
Figure 9:
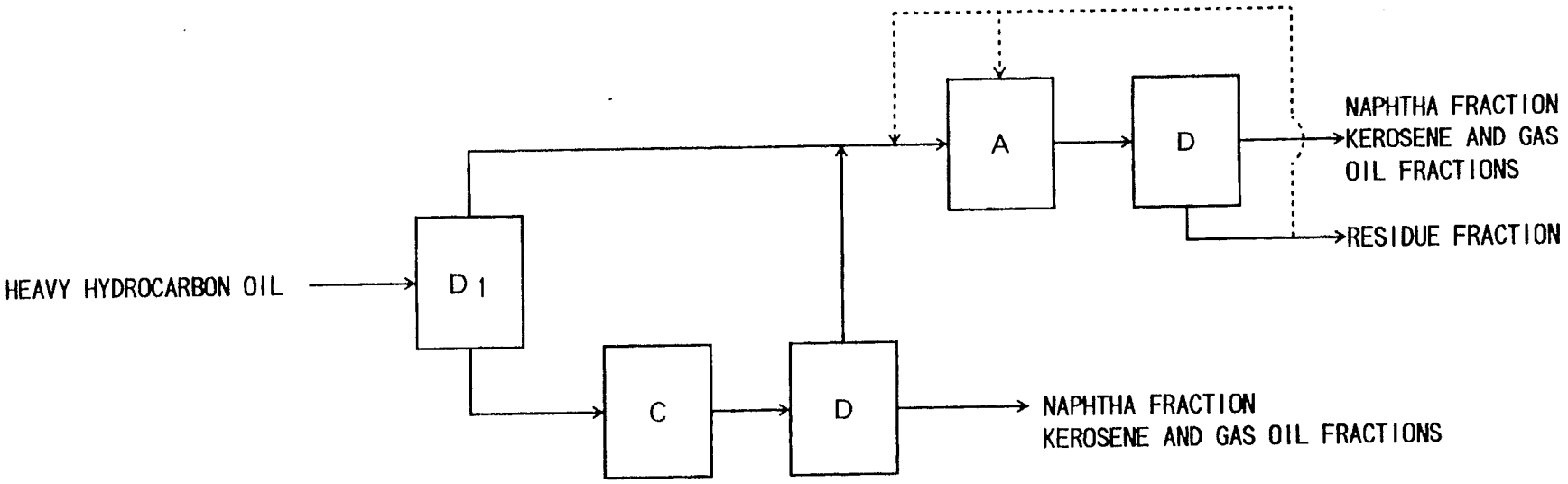
FIG. 9 is a drawing explaining the basic concept of Improved Embodiment 5.

FIG. 8 is a drawing explaining the basic concept of Embodiment 5. FIG. 9 is a drawing explaining the basic concept of Improved Embodiment 5.

The flow rate of oils based on the flow rate of the feed heavy hydrocarbon oil in each process is different depending on the situation of the operation but generally in the following range: the vacuum gas oil and the vacuum residue which are obtained by the vacuum distillation of the heavy hydrocarbon oil, 20 to 80 volume % for each of them; the residue which is obtained by thermal hydrocracking of the vacuum residue with the slurry bed, 2 to 64 volume %; the combined oils of the residue obtained after the thermal hydrocracking and the vacuum gas oil in the hydrocracking process, 28 to 96 volume %; the residue after the hydrotreatment including the recycled oil, 0 to 68 volume %; and the feed oils in the hydrotreatment process when the residue is recycled, 28 to 164 volume %.

To summarize the advantages obtained by the invention, the naphtha fraction and the kerosene and gas oil fraction can be efficiently obtained with a high yield from the heavy hydrocarbon oil by hydrotreating the heavy hydrocarbon oil by the treatment comprising hydrodemetallizing and hydrocracking the heavy hydrocarbon oil successively and thereafter hydrodesulfurizing and hydrodenitrogenating the treated heavy hydrocarbon oil.

The naphtha fraction and the kerosene and gas oil fraction can be efficiently obtained with a high yield from the heavy hydrocarbon oil also by the combined treatment of the hydrotreatment described above and the fluid catalytic cracking.

The naphtha fraction and the kerosene and gas oil fraction can be efficiently obtained with a high yield from the heavy hydrocarbon oil also by the combined treatment of the hydrotreatment, the thermal hydrocracking with the slurry bed and the fluid catalytic cracking respectively described above.

The naphtha fraction and the kerosene and gas oil fraction can be efficiently obtained with a high yield from the heavy hydrocarbon oil also by the combined treatment of the hydrotreatment described above and the thermal hydrocracking with the slurry bed and by recycling the vacuum gas oil and the vacuum residue obtained in the above processes to the heavy hydrocarbon oil in a suitable manner.

The naphtha fraction and the kerosene and gas oil fraction can be efficiently obtained with a high yield from the heavy hydrocarbon oil also by the combined treatment of the vacuum distillation, the thermal hydrocracking with the slurry bed and the hydrotreatment or by recycling the residue obtained by the hydrotreatment process to a stage before or after the hydrodemetallization reactor in a suitable manner.

The methods of the invention can utilize the heavy hydrocarbon oil which has been consumed as fuel for boilers and the like as the resource for obtaining the naphtha fraction and the kerosene and gas oil fraction which are highly more valuable. Thus, the industrial advantage of the method is very remarkable.

The invention will be understood more readily with reference to the following examples; however, these examples are intended to illustrate the invention and are not to be construed to limit the scope of the invention.

Example 1 (Invention 1)

The following Arabian heavy atmospheric residue was used as the feed heavy hydrocarbon oil:

| Properties | |
|---|---|
| specific gravity | 0.9798 |
| kinematic viscosity (50° C.) | 1098 cSt |
| sulfur content | 4.13 weight % |
| nitrogen content | 2,500 ppm |
| vanadium content | 85 ppm |
| nickel content | 26 ppm |
| carbon residue | 15 weight % |
| asphaltene content | 7.7 weight % |

The atmospheric residue had the initial boiling point of 281° C., the 5% distillation temperature of 341° C., the 10% distillation temperature of 376° C., 30% distillation temperature of 460° C. and the 50% distillation temperature of 546° C. This result was obtained by evaluation time of 400 to 1,400 hours.

Catalysts for the catalytic hydrotreatment

1) Hydrodemetallization catalyst alumina as the supporter; nickel oxide, 3 weight %; molybdenum oxide, 1.5 weight %; and vanadium oxide, 3 weight %.
2) Hydrocracking catalyst FeSHY-$Al_2O_3$ containing 65 weight % of FeSHY (an iron-containing aluminosilicate prepared according to Example 1 of Laid Open Japanese Patent Application Heisei 2-289419) as the supporter; cobalt oxide, 4 weight %; and molybdenum oxide, 10 weight %.
3) Hydrodesulfurization and hydrodenitrogenation catalyst alumina as the supporter; nickel oxide, 1 weight %; cobalt oxide, 1 weight %; and molybdenum oxide, 11 weight %.

Into a 1 liter fixed bed reactor, 21 volume % of the hydrodemetallization catalyst, 26 volume % of the hydrocracking catalyst and 53 volume % of the hydrodesulfurization and hydrodenitrogenation catalyst were charged in this order successively. The Arabian heavy atmospheric residue was treated in the presence of these catalysts in the condition of the partial pressure of hydrogen of 160 kg/cm$^2$G and the hydrogen/oil ratio of 800 Nm$^3$/kl. The Arabian heavy atmospheric residue was passed downward through the reactor at the flow rate of 160 cc/hr. Temperatures in each catalyst layer were: 407° C. at the hydrodemetallization catalyst layer, 405° C. in the hydrocracking catalyst layer and 402° C. in the hydrodesulfurization and hydrodenitrogenation catalyst layer.

Example 2 (Embodiment 1)

The same kind of the heavy hydrocarbon oil as in Example 1 was used as the feed oil. The same kinds of catalysts for the hydrocracking as in Example 1 were also used here.

Into a 1 liter fixed bed reactor, 21 volume % of the hydrodemetallization catalyst, 36 volume % of the hydrocracking catalyst and 43 volume % of the hydrodesulfurization and hydrodenitrogenation catalyst were charged in this order successively. The Arabian heavy atmospheric residue was treated in the presence of these catalysts in the condition of the partial pressure of hydrogen of 160 kg/cm$^2$G and the hydrogen/oil ratio of 800 Nm$^3$/kl. The Arabian heavy atmospheric residue was passed downward through the reactor at the flow rate of 160 cc/hr. Temperatures in each catalyst layer were: 390° C. at the hydrodemetallization catalyst layer, 395° C. in the hydrocracking catalyst layer and 370° C. in the hydrodesulfurization and hydrodenitrogenation catalyst layer.

Comparative Example 1

The same kind of the heavy hydrocarbon oil as in Example 1 was used as the feed oil. The same kinds of catalysts for the hydrocracking as in Example 1 were also used here.

Into a 1 liter fixed bed reactor, 21 volume % of the hydrodemetallization catalyst, 53 volume % of the hydrodesulfurization and hydrodenitrogenation catalyst and 26 volume % of the hydrocracking catalyst were charged in this order successively. The Arabian heavy atmospheric residue was treated in the presence of these catalysts in the condition of the partial pressure of hydrogen of 160 kg/cm$^2$G and the hydrogen/oil ratio of 800 Nm$^3$/kl. The Arabian heavy atmospheric residue was passed downward through the reactor at the flow rate of 160 cc/hr. Temperatures in each catalyst layer were: 407° C. at the hydrodemetallization catalyst layer, 402° C. in the hydrodesulfurization and hydrodenitrogenation catalyst layer and 405° C. in the hydrocracking catalyst layer.

Comparative Example 2

The same kind of the heavy hydrocarbon oil as in Example 1 was used as the feed oil. The same kinds of catalysts for the hydrocracking as in Example 1 were also used here.

Into a 1 liter fixed bed reactor, 21 volume % of the hydrodemetallization catalyst and 79 volume % of the hydrodesulfurization and hydrodenitrogenation catalyst were charged in this order successively. The Arabian heavy atmospheric residue was treated in the presence of these catalysts in the condition of the partial pressure of hydrogen of 160 kg/cm$^2$G and the hydrogen/oil ratio of 800 Nm$^3$/kl. The Arabian heavy atmospheric residue was passed downward through the reactor at the flow rate of 160 cc/hr. Temperatures in each catalyst layer were: 407° C. at the hydrodemetallization catalyst layer and 403° C. in the hydrodesulfurization and hydrodenitrogenation catalyst layer.

The oils coming out of the reactor in Examples 1 and 2 and Comparative Examples 1 and 2 were treated according to the general method and then the liquid fractions were fractionated into each fraction by the atmospheric distillation according to the general method.

Results of the measurements in Examples 1 and 2 and Comparative Examples 1 and 2 are shown in Table 1.

TABLE 1

| | naphtha fraction (volume %) | kerosene and gas oil fraction (volume %) | residue (volume %) | 343° C.+ conversion (weight %) |
|---|---|---|---|---|
| Example 1 | 31 | 33 | 42 | 58 |
| Example 2 | 21 | 30 | 54 | 45 |
| Comparative Example 1 | 7 | 27 | 68 | 30 |
| Comparative Example 2 | 5 | 25 | 72 | 26 |

The results in Table 1 show that, in Examples 1 and 2, the fraction of 343° C. or lower could be obtained by the cracking of the fraction of 343° C. or higher with a very excellent yield. In Example 1, the 343° C.+conversion increased by about 30% in comparison with Comparative Example 2 which is in the same condition as the conventional atmospheric residue hydrodesulfurization method.

The results of Comparative Example 1 in which the feed oil was treated with the hydrodemetallization, the hydrodesulfurization and hydrodenitrogenation and the hydrocracking in this order show that the result was almost the same as in the conventional method even though the hydrocracking process was introduced.

The 343°C.+ conversion was obtained according to the following equation:

343° C.+conversion=(weight % of the fraction of 343° C. or higher in the feed oil−weight % of the fraction of 343° C. or higher in the product oil)/(weight % of the fraction of 343° C. or higher in the feed oil)

Boiling point ranges of the fractions were $C_5$ to 171° C. for the naphtha fraction, 171 to 343° C. for the kerosene and gas oil fraction and 343° C. or higher for the residue.

Example 3 (Embodiment 2)

The following Arabian heavy atmospheric residue was used as the feed heavy hydrocarbon oil:

| Properties | |
|---|---|
| specific gravity | 0.9852 |
| kinematic viscosity (50° C.) | 2,018 cSt |
| sulfur content | 4.14 weight % |
| nitrogen content | 2,430 ppm |
| vanadium content | 95 ppm |
| nickel content | 30 ppm |
| carbon residue | 15.1 weight % |
| asphaltene content | 9.3 weight % |

In the atmospheric distillation after the hydrotreatment, the fractions were separated as following: the gas fraction, lower than $C_5$; the light naphtha fraction, $C_5$ to 82° C.; the heavy naphtha fraction, 82° to 150° C.; the kerosene and gas oil fraction, 150° to 343° C.; and the residue, 343° C. and higher. In the atmospheric distillation after the fluid catalytic cracking process, fractions were separated as following: the gasoline fraction, $C_5$ to 180° C.; the gas oil fraction, 180° to 360° C.; and the residue, 360° C. or higher. These results were obtained by evaluation time of 1,000 hours.

1) Hydrotreatment (1) Hydrodemetallization catalyst alumina as the supporter; nickel oxide, 3 weight %;

molybdenum oxide, 1.5 weight %; and vanadium oxide, 3 weight %.

(2) Hydrocracking catalyst

FeSHY-$Al_2O_3$ containing 65 weight % of FeSHY (an iron-containing aluminosilicate prepared according to Example 1 in Japanese Patent Publication Showa 61-24433) as a supporter; cobalt oxide, 4 weight % and molybdenum oxide 10 weight %.

(3) Hydrodesulfurization and hydrodenitrogenation catalyst alumina as the supporter; nickel oxide, 1 weight %; cobalt oxide, 1 weight %; and molybdenum oxide, 11 weight %.

(4) Conditions of hydrotreatment

| | |
|---|---|
| temperature | 390~410° C. |
| partial pressure of hydrogen | 130 kg/cm$^2$G |
| hydrogen/oil ratio | 1,200 Nm$^3$/kl |

Into a 1 liter fixed bed reactor, 20 volume % of the hydrodemetallization catalyst, 60 volume % of the hydrocracking catalyst and 20 volume % of the hydrodesulfurization and hydrodenitrogenation catalyst were charged in this order successively. The Arabian heavy atmospheric residue described above was treated in the condition described above. The Arabian heavy atmospheric residue was passed downward through the reaction vessel at the flow rate of 200 cc/hr.

The oil coming out of the reactor was treated according to the general method and then the liquid fraction was separated to fractions by the atmospheric distillation according to the general method. Result of the separation by distillation is shown in Table 2.

TABLE 2

| kind of the fraction | | yield | |
|---|---|---|---|
| gas | (~$C_4$) | 5.0 | (weight %) |
| light naphtha | (C5~82° C.) | 5.1 | (volume %) |
| heavy naphtha | (82~150° C.) | 20.6 | (volume %) |
| kerosene and gas oil | (150~343° C.) | 40.1 | (volume %) |
| residue | (343° C. or higher) | 40.8 | (volume %) |

2) Fluid catalytic cracking (1) Properties of the residue

| | |
|---|---|
| specific gravity | 0.923 |
| kinematic viscosity (50° C.) | 217 cSt |
| sulfur content | 0.46 weight % |
| nitrogen content | 1,290 ppm |
| vanadium content | 0.7 ppm |
| nickel content | 2.1 ppm |
| carbon residue | 7.48 weight % |

(2) Fluid catalytic cracking catalyst

The USY type residue FCC equilibrium catalyst ($Al_2O_3$, 23 weight %; surface area, 156 m$^2$/g; USY: a Y-type zeolite treated with steaming)

(3) Condition of the fluid catalytic cracking

| | |
|---|---|
| reaction temperature | 500~525° C. |
| regeneration temperature | 750~850° C. |
| catalyst/oil ratio | 5~7 |
| feed rate of the residue | 1 liter/hr |
| a circulating flow type bench unit | |

The product of the catalytic cracking was separated to fractions by the atmospheric distillation according to the general method. Result of the separation by distillation is shown in Table 3.

TABLE 3

| kind of the fraction | | yield | |
|---|---|---|---|
| LPG | ($C_3$, $C_4$) | 17.2 | (volume %) |
| gasoline | ($C_5$~180° C.) | 49.2 | (volume %) |
| gas oil | (180~360° C.) | 28.4 | (volume %) |
| residue | (360° C. or higher) | 10.4 | (volume %) |

The overall yields by the combination of the hydrotreatment and the fluid catalytic cracking are shown in Table 4.

TABLE 4

| kind of the fraction | | yield | |
|---|---|---|---|
| gas | (~$C_4$) | 6.2 | (weight %) |
| LPG | ($C_3$, $C_4$) | 7.0 | (volume %) |
| light naphtha | ($C_5$~82° C.) | 5.1 | (volume %) |
| heavy naphtha | (82~150° C.) | 20.6 | (volume %) |
| kerosene and gas oil | (150~343° C.) | 40.1 | (volume %) |
| FCC gasoline | ($C_5$~180° C.) | 20.1 | (volume %) |
| gas oil by catalytic cracking | (180~360° C.) | 11.6 | (volume %) |
| residue by catalytic cracking | (360° C. or higher) | 4.2 | (volume %) |

Example 4 (Embodiment 2)

The same heavy hydrocarbon oil as in Example 1 was used as the feed oil.

1) Hydrotreatment (1) Hydrodemetallization catalyst alumina as the supporter; nickel oxide, 3 weight %; molybdenum oxide, 1.5 weight %; and vanadium oxide, 3 weight %.

(2) Hydrocracking catalyst

FeSHY-$Al_2O_3$ containing 65 weight % of FeSHY (an iron-containing aluminosilicate prepared according to Example 1 in Laid Open Japanese Patent Application Heisei 2-289419) as a supporter; cobalt oxide, 4 weight % and molybdenum oxide 10 weight %.

(3) Hydrodesulfurization and hydrodenitrogenation catalyst

Alumina as the supporter; nickel oxide, 1 weight %; cobalt oxide, 1 weight %; and molybdenum oxide, 11 weight %.

(4) Conditions of hydrotreatment

| | |
|---|---|
| temperature | 390~410° C. |
| partial pressure of hydrogen | 160 kg/cm$^2$G |
| hydrogen/oil ratio | 800 Nm$^3$/kl |

Into a 1 liter fixed bed reactor, 21 volume % of the hydrodemetallization catalyst, 36 volume % of the hydrocracking catalyst and 43 volume % of the hydrodesulfurization and hydrodenitrogenation catalyst were charged in this order successively. The Arabian heavy atmospheric residue described above was treated in the condition described above. The Arabian heavy atmosperic residue was passed downward through the reaction vessel at the flow rate of 200 cc/hr.

The oil coming out of the reactor was treated according to the general method and then the liquid fraction was separated to fractions by the atmospheric distillation according to the general method. Result of the separation by distillation is shown in Table 5.

TABLE 5

| kind of the fraction | | yield | |
|---|---|---|---|
| gas | (~$C_4$) | 4.0 | (weight %) |
| light naphtha | ($C_5$~82° C.) | 3.9 | (volume %) |
| heavy naphtha | (82~150° C.) | 16.8 | (volume %) |
| kerosene and gas oil | (150~343° C.) | 30.2 | (volume %) |
| residue | (343° C. or higher) | 54.9 | (volume %) |

2) Fluid catalytic cracking (1) Properties of the residue

| | |
|---|---|
| specific gravity | 0.930 |
| kinematic viscosity (50° C.) | 180 cSt |
| sulfur content | 0.47 weight % |
| nitrogen content | 1,320 ppm |
| vanadium content | 0.9 ppm |
| nickel content | 2.5 ppm |
| carbon residue | 7.69 weight % |

(2) Fluid catalytic cracking catalyst

The USY type residue FCC equilibrium catalyst ($Al_2O_3$, 23 weight %; surface area, 156 m$^2$/g; USY: a Y-type zeolite treated with steaming)

(3) Condition of the fluid catalytic cracking

| | |
|---|---|
| reaction temperature | 500~525° C. |
| regeneration temperature | 750~850° C. |
| catalyst/oil ratio | 5~7 |
| feed rate of the residue | 1 liter/hr |
| a circulating flow type bench unit | |

The product of the catalytic cracking was separated to fractions by the atmospheric distillation according to the general method. Result of the separation by distillation is shown in Table 6.

TABLE 6

| kind of the fraction | | yield | |
|---|---|---|---|
| LPG | ($C_3$, $C_4$) | 17.0 | (volume %) |
| gasoline | ($C_5$~180° C.) | 49.6 | (volume %) |
| gas oil | (180~360° C.) | 28.2 | (volume %) |
| residue | (360° C. or higher) | 10.2 | (volume %) |

The overall yields by the combination of the hydrotreatment and the fluid catalytic cracking are shown in Table 7.

TABLE 7

| kind of the fraction | | yield | |
|---|---|---|---|
| gas | (~$C_4$) | 5.5 | (weight %) |
| LPG | ($C_3$, $C_4$) | 9.3 | (volume %) |
| light naphtha | ($C_5$~82° C.) | 3.9 | (volume %) |
| heavy naphtha | (82~150° C.) | 16.8 | (volume %) |
| kerosene and gas oil | (150~343° C.) | 30.2 | (volume %) |
| FCC gasoline | ($C_5$~180° C.) | 27.2 | (volume %) |
| gas oil by catalytic cracking | (180~360° C.) | 15.5 | (volume %) |
| residue by catalytic cracking | (360° C. or higher) | 5.6 | (volume %) |

Comparative Example 3

The same heavy hydrocarbon oil as the oil used in Example 3 was used as the feed oil.

The feed oil was treated by the hydrodemetallization, the hydrodesulfurization and the hydrodenitrogenation in the conditions described in the following and then separated to fractions by the atmospheric distillation according to the general method. Result of the separation is shown in Table 8.

1) Hydrotreatment (1) Hydrodemetallization catalyst alumina as the supporter; nickel oxide, 3 weight %; molybdenum oxide, 1.5 weight %; and vanadium oxide, 3 weight %.

(2) Hydrodesulfurization and hydrodenitrogenation catalyst

Alumina as the supporter; nickel oxide, 1 weight %; cobalt oxide, 1 weight %; and molybdenum oxide, 11 weight %.

| | |
|---|---|
| temperature of treatment | 390~410° C. |
| partial pressure of hydrogen | 130 kg/cm$^2$G |
| LHSV | 0.2 hr$^{-1}$ |
| reactor | fixed bed, 1 liter (demetallization, 20 volume %; desulfurization, 80 volume %) |

TABLE 8

| kind of the fraction | | Yield | |
|---|---|---|---|
| gas | (~$C_4$) | 4.0 | (weight %) |
| light naphtha | ($C_5$~82° C.) | 0.5 | (volume %) |
| heavy naphtha | (82~150° C.) | 1.9 | (volume %) |
| kerosene and gas oil | (150~343° C.) | 14.5 | (volume %) |
| residue | (343° C. or higher) | 86.3 | (volume %) |

The residue separated by the atmospheric distillation was fluid catalytically cracked by the same method as in Example 3.

2) The fluid catalytic cracking (1) Properties of the residue

| | |
|---|---|
| specific gravity | 0.937 |
| kinematic viscosity (50° C.) | 165 cSt |
| sulfur content | 0.49 weight % |
| nitrogen content | 1,705 ppm |
| vanadium content | 1.5 ppm |
| nickel content | 3.9 ppm |
| carbon residue | 7.09 weight % |

(2) Fluid catalytic cracking catalyst

The USY type residue FCC equilibrium catalyst ($Al_2O_3$, 23 weight %; surface area, 156 $m^2/g$; USY: a Y-type zeolite treated with steaming)

(3) Condition of the fluid catalytic cracking

| | |
|---|---|
| reaction temperature | 500~525° C. |
| regeneration temperature | 750~850° C. |
| catalyst/oil ratio | 5~7 |
| feed rate of the residue | 1 liter/hr |
| a circulating flow type bench unit | |

The product of the catalytic cracking was separated to fractions by the atmospheric distillation according to the general method. Result of the separation by distillation is shown in Table 9.

TABLE 9

| kind of the fraction | | yield | |
|---|---|---|---|
| LPG | ($C_3$, $C_4$) | 17.1 | (volume %) |
| gasoline | ($C_5$~180° C.) | 49.4 | (volume %) |
| gas oil | (180~360° C.) | 28.3 | (volume %) |
| residue | (360° C. or higher) | 10.3 | (volume %) |

The overall yields after the two stage treatment comprising the combined treatment of the hydrodemetallization, the hydrodesulfurization and the hydrodenitrogenation and the fluid catalytic cracking of the treated oil are shown in Table 10.

TABLE 10

| kind of the fraction | | yield | |
|---|---|---|---|
| gas | (~$C_4$) | 6.0 | (weight %) |
| LPG | ($C_3$, $C_4$) | 14.8 | (volume %) |
| light naphtha | (C5~82° C.) | 0.5 | (volume %) |
| heavy naphtha | (82~150° C.) | 1.9 | (volume %) |
| kerosene and gas oil | (150~343° C.) | 14.5 | (volume %) |
| FCC gasoline | ($C_5$~180° C.) | 42.6 | (volume %) |
| gas oil by catalytic cracking | (180~360° C.) | 24.4 | (volume %) |
| residue by catalytic cracking | (343° C. or higher) | 8.9 | (volume %) |

When the result of Comparative Example 3 is compared with the results of Examples 3 and 4, the result of Comparative Example 3 shows the yield of FCC gasoline about twice as high as the corresponding yields in Examples 3 and 4 because the method of Comparative Example 3 was focused on the production of FCC gasoline. However, the method of Comparative Example 3 produced only less than a half of the kerosene and gas oil of the method in Examples 3 and 4 and, moreover, the quality of the gas oil produced in Comparative Example 3 was inferior because the method comprised the desulfurization but not the hydrotreatment. The quality of the gas oils are shown in Table 11.

TABLE 11

| property | Example 3 | Comparative Example 3 |
|---|---|---|
| sulfur (weight %) | 0.03 | 0.16 |

TABLE 11-continued

| property | Example 3 | Comparative Example 3 |
|---|---|---|
| nitrogen (ppm) | 63 | 400 |
| cold filter plugging point (°C.) | −11 | −5 |
| pour point (°C.) | −22.5 | −15.0 |

The gas oil produced in Example 3 had the lower content of sulfur and nitrogen as well as the lower cold filter plugging point and pour point. On the other hand, the gas oil produced by the atmospheric residue hydrodesulfurization in Comparative Example 3 needs to be treated with the hydrotreatment additionally when it is to be used as the diesel fuel for transportation. The oil produced in Comparative Example 3 contained about 25% of catalytically cracked gas oil fraction containing a large amount of polycyclic aromatic compounds and having a lower cetane number. Thus, the method of Comparative Example 3 is shown to be a method of lower value.

By the method of Example 3, gasoline fraction and high quality middle distillate (kerosene and gas oil) can be produced in about equal amounts and the reformed gasoline feedstock and the FCC gasoline are produced in about equal amounts. The ratio of gasoline fraction and middle distillate and the ratio of reformed gasoline feedstock and FCC gasoline in the gasoline fraction can be varied by varying the cracking level in the hydrocracking and it is easier to comply with the need of market. This again shows that the methods of Examples 3 and 4 are superior to the method of Comparative Example 3 which can produce FCC gasoline alone.

Example 5 (Embodiment 3)

The same heavy hydrocarbon oil as the oil used in Example 3 was used as the feed oil.

1) Hydrotreatment (1) Hydrodemetallization catalyst alumina as the supporter; nickel oxide, 3 weight %; molybdenum oxide, 1.5 weight %; and vanadium oxide, 3 weight %.

(2) Hydrocracking catalyst

FeSHY-$Al_2O_3$ containing 65 weight % of FeSHY (an iron-containing aluminosilicate prepared according to Example 1 in Laid Open Japanese Patent Application Heisei 2-289419) as a supporter; cobalt oxide, 4 weight % and molybdenum oxide 10 weight %.

(3) Hydrodesulfurization and hydrodenitrogenation catalyst alumina as the supporter; nickel oxide, 1 weight %; cobalt oxide, 1 weight %; and molybdenum oxide, 11 weight %.

(4) Conditions of hydrotreatment

| | |
|---|---|
| temperature | 390~410° C. |
| partial pressure of hydrogen | 130 $kg/cm^2$ |
| hydrogen/oil ratio | 1,200 $Nm^3/kl$ |

Into a 1 liter fixed bed reactor, 20 volume % of the hydrodemetallization catalyst, 50 volume % of the hydrocracking catalyst and 30 volume % of the hydrodesulfurization and hydrodenitrogenation catalyst were charged in this order successively. The Arabian heavy atmospheric residue described above was treated in the condition described above. The Arabian heavy atmospheric residue was passed downward through the reactor at the flow rate of 200 cc/hr.

The oil coming out of the reactor was treated according to the general method and then the liquid fraction was separated to fractions by the atmospheric distillation according to the general method. Result of the separation by distillation is shown in Table 12.

TABLE 12

| kind of the fraction | | yield | |
|---|---|---|---|
| gas | ($\sim C_4$) | 5.2 | (weight %) |
| light naphtha | ($C_5 \sim 82°$ C.) | 5.5 | (volume %) |
| heavy naphtha | ($82 \sim 150°$ C.) | 22.0 | (volume %) |
| kerosene and gas oil | ($150 \sim 343°$ C.) | 43.7 | (volume %) |
| residue | (343° C. or higher) | 35.8 | (volume %) |

2) Vacuum distillation of the hydrotreatment residue

The hydrotreatment residue formed in the hydrotreatment of 1) was vacuum distilled according to the general method and the vacuum gas oil I and the vacuum residue I were separated. Result of the separation by the vacuum distillation was as following.

(1) Properties of the hydrotreatment residue

| | |
|---|---|
| specific gravity | 0.923 |
| kinematic viscosity (50° C.) | 217 cSt |
| sulfur content | 0.46 weight % |
| nitrogen content | 1,290 ppm |
| carbon residue | 7.48 weight % |
| vanadium content | 0.7 ppm |
| nickel content | 2.1 ppm |

(2) Result of the vacuum distillation

| yield of the distilled fractions | |
|---|---|
| vacuum gas oil I (VGO, $343 \sim 525°$ C.) | 79.4 volume % |
| vacuum residue I (VR, 525° C. or higher) | 20.6 volume % |

3) Thermal hydrocracking of the vacuum residue (1) Properties of the vacuum residue

| | |
|---|---|
| specific gravity | 1.01 |
| kinematic viscosity (50° C.) | 1,850 cSt |
| sulfur content | 2.14 weight % |
| nitrogen content | 3,200 ppm |
| carbon residue | 22.5 weight % |
| vanadium content | 3.0 ppm |
| nickel content | 8.2 ppm |

(2) Reaction conditions

| | |
|---|---|
| reaction temperature | 450° C. |
| reaction pressure | 70 kg/cm$^2$ |
| LHSV | 0.45 hr$^{-1}$ |
| catalyst/oil ratio | 0.09 |
| reactor | a continuous autoclave reactor (700 cc) |

(3) Catalyst

| | |
|---|---|
| particle size | $30 \sim 200$ μm diameter |
| used catalyst in the atmospheric residue hydrodesulfurization unit | 20 weight % (vanadium oxide, 0.7 weight %; nickel oxide, 2.2 weight %) |
| used catalyst in the fluid catalytic cracking unit | 80 weight % (vanadium oxide, 1,700 ppm; nickel oxide, 1,500 ppm) |

-continued

The vacuum residue I obtained by the distillation of 2) was treated according to the method described before. The liquid fraction was separated to the vacuum gas oil II and the vacuum residue II according the general method by the atmospheric and vacuum distillations. Result of the separation by the vacuum distillation is shown in Table 13.

TABLE 13

| kind of the fraction | | yield | |
|---|---|---|---|
| gas | ($\sim C_4$) | 7.0 | (weight %) |
| naphtha | ($C_5 \sim 150°$ C.) | 12.2 | (volume %) |
| kerosene | ($150 \sim 232°$ C.) | 12.6 | (volume %) |
| gas oil | ($232 \sim 343°$ C.) | 24.7 | (volume %) |
| vacuum gas oil | ($343 \sim 525°$ C.) | 36.4 | (volume %) |
| vacuum residue | (525° C. or higher) | 10.0 | (volume %) |

4) Fluid catalytic cracking of the vacuum gas oil (1) Properties of the gas oil

| | |
|---|---|
| specific gravity | 0.899 |
| kinematic viscosity (50° C.) | 11 cSt |
| sulfur content | 0.34 weight % |
| nitrogen content | 940 ppm |
| vanadium content | 0.5 ppm or lower |
| nickel content | 0.5 ppm or lower |

(2) Fluid catalytic cracking catalyst a commercial silica-alumina catalyst (3) Condition of the fluid catalytic cracking

| | |
|---|---|
| reaction temperature | 482° C. |
| catalyst/oil ratio | 3.0 |
| weight space velocity | 16 hr$^{-1}$ |
| flow time of oil according to MAT (microactivity testing method) of ASTM D-3907 | 75 seconds |

The vacuum gas oil I and the vacuum gas oil II obtained in 1) and 2) were fluid catalytically cracked according to the general method. The product of the catalytic cracking was separated to fractions by the distillation according to the general method. Result of the separation by distillation is shown in Table 14.

TABLE 14

| kind of the fraction | | yield | |
|---|---|---|---|
| LPG | | 28.8 | (volume %) |
| gasoline | ($C_5 \sim 180°$ C.) | 62.7 | (volume %) |
| gas oil | ($180 \sim 360°$ C.) | 12.4 | (volume %) |
| residue | (360° C. or higher) | 5.8 | (volume %) |

The overall yields by the combination of the hydrotreatment, the thermal hydrocracking and the fluid catalytic cracking are shown in Table 15.

TABLE 15

| kind of the fraction | | yield | |
|---|---|---|---|
| gas | | 6.9 | (weight %) |
| LPG | ($C_3$, $C_4$) | 9.0 | (volume %) |
| light naphtha | ($C_5 \sim 82°$ C.) | 6.4 | (volume %) |
| heavy naphtha | ($82 \sim 150°$ C.) | 22.0 | (volume %) |
| kerosene and gas oil | ($150 \sim 343°$ C.) | 46.4 | (volume %) |
| FCC gasoline | ($C_5 \sim 180°$ C.) | 19.5 | (volume %) |
| gas oil by catalytic cracking | ($180 \sim 360°$ C.) | 3.9 | (volume %) |

TABLE 15-continued

| kind of the fraction | | yield | |
|---|---|---|---|
| residue | (360° C. or higher) | 2.5 | (volume %) |

Example 6 (Embodiment 3)

The same heavy hydrocarbon oil as the oil used in Example 1 was used as the feed oil.

1) Hydrotreatment (1) Hydrodemetallization catalyst alumina as the supporter; nickel oxide, 3 weight %; molybdenum oxide, 1.5 weight %; and vanadium oxide, 3 weight %.

(2) Hydrocracking catalyst

FeSHY-$Al_2O_3$ containing 65 weight % of FeSHY (an iron-containing aluminosilicate prepared according to Example 1 in Japanese Patent Publication Showa 61-24433) as a supporter; cobalt oxide, 4 weight % and molybdenum oxide 10 weight %.

(3) Hydrodesulfurization and hydrodenitrogenation catalyst alumina as the supporter; nickel oxide, 1 weight %; cobalt oxide, 1 weight %; and molybdenum oxide, 11 weight %.

(4) Conditions of hydrotreatment

| | |
|---|---|
| temperature | 390~410° C. |
| partial pressure of hydrogen | 160 kg/cm$^2$ |
| hydrogen/oil ratio | 800 Nm$^3$/kl |

Into a 1 liter fixed bed reactor, 20 volume % of the hydrodemetallization catalyst, 50 volume % of the hydrocracking catalyst and 30 volume % of the hydrodesulfurization and hydrodenitrogenation catalyst were charged in this order successively. The Arabian heavy atmospheric residue described above was treated in the condition described above. The Arabian heavy atmospheric residue was passed downward through the reactor at the flow rate of 200 cc/hr.

The oil coming out of the reactor was treated according to the general method and then the liquid fraction was separated to fractions by the atmospheric distillation according to the general method. Result of the separation by distillation is shown in Table 16.

TABLE 16

| kind of the fraction | | yield | |
|---|---|---|---|
| gas | (~$C_4$) | 3.7 | (weight %) |
| light naphtha | ($C_5$~82° C.) | 2.4 | (volume %) |
| heavy naphtha | (82~150° C.) | 10.7 | (volume %) |
| kerosene and gas oil | (150~343° C.) | 30.8 | (volume %) |
| residue | (343° C. or higher) | 61.1 | (volume %) |

2) Vacuum distillation of the hydrotreatment residue

The hydrotreatment residue formed in the hydrotreatment treatment of 1) was vacuum distilled according to the general method and the vacuum gas oil I and the vacuum residue I were separated. Result of the separation by the vacuum distillation was as following.

(1) Properties of the hydrotreatment residue

| | |
|---|---|
| specific gravity | 0.920 |
| kinematic viscosity (50° C.) | 196 cSt |
| sulfur content | 0.45 weight % |
| nitrogen content | 1,210 ppm |

-continued

| | |
|---|---|
| carbon residue | 7.45 weight % |
| vanadium content | 1.7 ppm |
| nickel content | 3.2 ppm |

(2) Result of the vacuum distillation

| yield of the distilled fractions | |
|---|---|
| vacuum gas oil I (VGO, 343~525° C.) | 62.3 volume % |
| vacuum residue I (VR, 525° C. or higher) | 37.7 volume % |

3) Thermal hydrocracking of the vacuum residue (1) Properties of the vacuum residue

| | |
|---|---|
| specific gravity | 1.00 |
| kinematic viscosity (50° C.) | 1,690 cSt |
| sulfur content | 1.20 weight % |
| nitrogen content | 2,900 ppm |
| carbon residue | 18.6 weight % |
| vanadium content | 4.3 ppm |
| nickel content | 8.3 ppm |

(2) Reaction conditions

| | |
|---|---|
| reaction temperature | 450° C. |
| reaction pressure | 70 kg/cm$^2$ |
| LHSV | 0.48 hr$^{-1}$ |
| catalyst/oil ratio | 0.09 |
| reactor | a continuous autoclave reactor (700 cc) |

(3) Catalyst

| | |
|---|---|
| particle size | 30~200 μm diameter |
| used catalyst in the atmospheric residue hydrodesulfurization unit | 20 weight % (vanadium oxide, 0.7 weight %; nickel oxide, 2.2 weight %) |
| used catalyst in the fluid catalytic cracking unit | 80 weight % (vanadium oxide, 1,700 ppm; nickel oxide, 1,500 ppm) |

The vacuum residue I obtained by the distillation of 2) was treated according to the method described before. After the thermal hydrocracking, the liquid fraction was separated to the vacuum gas oil II and the vacuum residue II according the general method by the atmospheric and vacuum distillations. Results of the separation by the vacuum distillation is shown in Table 17.

TABLE 17

| kind of the fraction | | yield | |
|---|---|---|---|
| gas | (~$C_4$) | 7.0 | (weight %) |
| naphtha | ($C_5$~150° C.) | 13.2 | (volume %) |
| kerosene | (150~232° C.) | 12.3 | (volume %) |
| gas | (232~343° C.) | 25.1 | (volume %) |
| vacuum gas oil | (343~525° C.) | 34.8 | (volume %) |
| vacuum residue | (525° C. or higher) | 10.2 | (volume %) |

4) Fluid catalytic cracking of the vacuum gas oil (1) Properties of the vacuum gas oil

| | |
|---|---|
| specific gravity | 0.901 |
| kinematic viscosity (50° C.) | 25 cSt |
| sulfur content | 0.16 weight % |
| nitrogen content | 960 ppm |
| vanadium content | 0.5 ppm or lower |

-continued

| | |
|---|---|
| nickel content | 0.5 ppm or lower |

nitrogen content 960 ppm (2) Fluid catalytic cracking catalyst a commercial silica-alumina catalyst (3) Condition of the fluid catalytic cracking

| | |
|---|---|
| reaction temperature | 482° C. |
| catalyst/oil ratio | 3.0 (catalyst 4.0 g) |
| weight space velocity | 16 $hr^{-1}$ |
| flow time of oil according to MAT (microactivity testing method) of ASTM D-3907 | 75 seconds |

To 100 volume parts of the sum of the vacuum gas oil I in 2) and the vacuum gas oil II in 3), 5 volume % of the vacuum residue II in 3) were mixed and the mixture was fluid catalytically cracked according to the general method. The product of the catalytic cracking was separated to fractions by the distillation according to the general method. Result of the separation by distillation is shown in Table 18.

TABLE 18

| kind of the fraction | | yield | |
|---|---|---|---|
| LPG | ($C_3$, $C_4$) | 28.0 | (volume %) |
| gasoline | ($C_5$~180° C.) | 60.9 | (volume %) |
| gas oil | (180~360° C.) | 12.3 | (volume %) |
| residue | (360° C. or higher) | 7.5 | (volume %) |

The overall yields by the combination of the hydrotreatment, the thermal hydrocracking and the fluid catalytic cracking are shown in Table 19.

TABLE 19

| kind of the fraction | | yield | |
|---|---|---|---|
| gas | (~$C_4$) | 6.7 | (weight %) |
| LPG | ($C_3$, $C_4$) | 13.6 | (volume %) |
| light naphtha | ($C_5$~82° C.) | 5.2 | (volume %) |
| heavy naphtha | (82~150° C.) | 10.7 | (volume %) |
| kerosene and gas oil | (150~343° C.) | 39.6 | (volume %) |
| FCC gasoline | ($C_5$~180° C.) | 29.5 | (volume %) |
| gas oil by catalytic cracking | (180~360° C.) | 6.0 | (volume %) |
| residue | (360° C. or higher) | 3.6 | (volume %) |

When the result of Comparative Example 3 is compared with the results of Examples 5 and 6, the method of Comparative Example 3 preduced the FCC gasoline in the amount about twice as high as the amount by the method of Examples 5 and 6 because the method of Comparative Example 3 was focused on the production of FCC gasoline. However, the product by the method of Comparative Example 3 produced kerosene and gas oil in the amount about a half of the amount by method of Examples 5 and 6. Moreover, the quality of the gas oil produced in Comparative Example 3 is inferior because the method comprises the desulfurization but not the hydrotreatment. The quality of the gas oils are shown in Table 20.

TABLE 20

| property | Example 5 | Comparative Example 3 |
|---|---|---|
| sulfur (weight %) | 0.04 | 0.16 |
| nitrogen (ppm) | 69 | 400 |
| cold filter plugging point (°C.) | −12 | −5 |

TABLE 20-continued

| property | Example 5 | Comparative Example 3 |
|---|---|---|
| pour point (°C.) | −22.5 | −15.0 |

The gas oils produced in Examples 5 and 6 had the lower contents of sulfur and nitrogen as well as the lower cold filter plugging point and pour point. On the other hand, the gas oil produced by the hydrodesulfurization in Comparative Example 3 needs to be treated with the hydrotreatment additionally when it is to be used as the diesel fuel for transportation. The oil produced in Comparative Example 3 contained about 25% of catalytically cracked gas oil fraction containing a large amount of polycyclic aromatic compounds and having a lower cetane number. Thus, the method of Comparative Example 3 is shown to be a method of lower value.

By the method of Examples 5, gasoline fraction and high quality middle distillate (kerosene and gas oil) can be produced in about equal amounts and the reformed gasoline feedstock and the FCC gasoline are produced in about equal amounts. The ratio of gasoline fraction and middle distillate and the ratio of reformed gasoline feed and FCC gasoline in the gasoline fraction can be varied by varying the cracking level of the hydrocracking and it is easier to comply with the need of market. This again shows that the methods of Examples 5 and 6 are superior to the method of Comparative Example 3 which can produce FCC gasoline alone.

Example 7 (Embodiment 4)

The same heavy hydrocarbon oil as the oil used in Example 3 was used as the feed oil.

To 100 volume parts of the feed Arabian heavy atmospheric residue, 34.5 volume parts of the vacuum gas oil I and 5.3 volume parts of the vacuum gas oil II both of which were produced by the hydrotreatment of the feed oil, followed by the thermal hydrocracking, were added for recycling at the stage before the hydrodemetallization. The hydrotreatment and the thermal hydrocracking were made by using the combined oil as the treating oil as described in the following.

| Properties of the treating oil was as following: | |
|---|---|
| specific gravity | 0.955 |
| kinematic viscosity (50° C.) | 560 cSt |
| sulfur content | 83 weight % |
| nitrogen content | 2,030 ppm |
| carbon residue | 9.9 weight % |
| vanadium | 62 ppm |
| nickel content | 20 ppm |

1) Hydrotreatment (1) Hydrodemetallization catalyst alumina as the supporter; nickel oxide, 3 weight %;

molybdenum oxide, 1.5 weight %; and vanadium oxide, 3 weight %.

(2) Hydrocracking catalyst $FeSHY-Al_2O_3$ containing 65 weight % of FeSHY (an iron-containing aluminosilicate prepared according to Example 1 in Laid Open Japanese Patent Application Heisei 2-289419) as a supporter; cobalt oxide, 4 weight %; and molybdenum oxide 10 weight %.

(3) Hydrodesulfurization and hydrodenitrogenation catalyst alumina as the supporter; nickel oxide, 1 weight %; cobalt oxide, 1 weight %; and molybdenum oxide, 11 weight %.

(4) Conditions of hydrotreatment

| | |
|---|---|
| temperature | 390~410° C. |
| partial pressure of hydrogen | 130 kg/cm$^2$ |
| hydrogen/oil ratio | 1,200 Nm$^3$/kl |

Into a 1 liter fixed bed reactor, 20 volume % of the hydrodemetallization catalyst, 50 volume % of the hydrocracking catalyst and 30 volume % of the hydrodesulfurization and hydrodenitrogenation catalyst were charged in this order successively. The combined oil described above was treated in the condition described above. The combined oil was passed downward through the reaction vessel at the flow rate of 200 cc/hr.

The oil coming out of the reactor was treated according to the general method and then the liquid fraction was separated to fractions by the atmospheric distillation according to the general method. Result of the separation by distillation is shown in Table 21.

TABLE 21

| kind of the fraction | | yield | |
|---|---|---|---|
| gas | (~$C_4$) | 7.0 | (weight %) |
| light naphtha | ($C_5$~82° C.) | 6.8 | (volume %) |
| heavy naphtha | (82~150° C.) | 30.1 | (volume %) |
| kerosene and gas oil | (150~343° C.) | 57.2 | (volume %) |
| residue | (343° C. or higher) | 49.1 | (volume %) |

2) Vacuum distillation of the hydrotreatment residue

The hydrotreatment residue formed in the hydrotreatment of 1) was vacuum distilled according to the general method and the vacuum as oil I and the vacuum residue I were separated. Result of the separation by the vacuum distillation was as following.

(1) Properties of the hydrotreatment residue

| | |
|---|---|
| specific gravity | 0.915 |
| kinematic viscosity (50° C.) | 185 cSt |
| sulfur content | 0.38 weight % |
| nitrogen content | 1,060 ppm |
| carbon residue | 3.03 weight % |
| vanadium content | 0.6 ppm |
| nickel content | 1.0 ppm |

(2) Result of the vacuum distillation

| yield of the distilled fractions | |
|---|---|
| vacuum gas oil (VGO, 343~525° C.) | 70.3 volume % |
| vacuum residue (VR, 525° C. or higher) | 29.7 volume % |

3) Thermal hydrocracking of the vacuum residue

The vacuum residue I obtained by the vacuum distillation of 2) was thermal hydrocracked according to the general method in the following conditions.

(1) Properties of the vacuum residue

| | |
|---|---|
| specific gravity | 0.985 |
| kinematic viscosity (50° C.) | 560 cSt |
| sulfur content | 1.26 weight % |
| nitrogen content | 3,480 ppm |
| carbon residue | 10.4 weight % |

-continued

| | |
|---|---|
| vanadium content | 4 ppm |

(2) Reaction conditions

| | |
|---|---|
| reaction temperature | 450° C. |
| reaction pressure | 70 kg/cm$^2$ |
| LHSV | 0.48 hr$^{-1}$ |
| catalyst/oil ratio | 0.09 |
| reactor | a continuous autoclave reactor (700 cc) |

(3) Catalyst

| | |
|---|---|
| particle size | 30~200 μm diameter |
| used catalyst in the atmospheric residue hydrodesulfurization unit | 20 weight % (vanadium oxide, 0.7 weight %; nickel oxide, 2.2 weight %) |
| used catalyst in the fluid catalytic cracking unit | 80 weight % (vanadium oxide, 1,700 ppm; nickel oxide, 1,500 ppm) |

After the thermal hydrocracking, the liquid fraction was separated to the vacuum gas oil II and the vacuum residue II according the general method by the atmospheric and vacuum distillations. Result of the distillation is shown in Table 22.

TABLE 22

| kind of the fraction | | yield | |
|---|---|---|---|
| gas | (~$C_4$) | 7.0 | (weight %) |
| naphtha | ($C_5$~150° C) | 12.0 | (volume %) |
| kerosene | (150~232° C.) | 12.4 | (volume %) |
| gas oil | (232~343° C.) | 24.5 | (volume %) |
| vacuum gas oil | (343~525° C.) | 36.3 | (volume %) |
| vacuum residue | (525° C. or higher) | 10.9 | (volume %) |

The overall yield by the combination of the hydrotreatment and the thermal hydrocracking is shown in Table 23.

TABLE 23

| kind of the fraction | | yield | |
|---|---|---|---|
| gas | (~$C_4$) | 9.9 | (weight %) |
| light naphtha | ($C_5$~82° C.) | 7.1 | (volume %) |
| heavy naphtha | (82~150° C.) | 31.5 | (volume %) |
| gas oil | (150~343° C.) | 62.6 | (volume %) |
| residue | (343° C. or higher) | 1.6 | (volume %) |

Example 8 (Invention 4)

The same heavy hydrocarbon oil as the oil used in Example 1 was used as the feed oil.

To 100 volume parts of the feed Arabian heavy atmospheric residue, 46.5 volume parts of the vacuum gas oil I, 21.4 volume parts of the vacuum gas oil II and 6.1 volume parts of the vacuum residue II all of which were produced by the hydrotreatment of the feed oil, followed by the thermal hydrocracking, were added. The hydrotreatment and the thermal hydrocracking were made by using the combined oil as the treating oil as described in the following.

1) Hydrotreatment (1) Hydrodemetallization catalyst alumina as the supporter; nickel oxide, 3 weight %; molybdenum oxide, 1.5 weight %; and vanadium oxide, 3 weight %.

(2) Hydrocracking catalyst

FeSHY-$Al_2O_3$ containing 65 weight % of FeSHY (an iron-containing aluminosilicate prepared according to Example 1 in Japanese Patent Publication Showa 61-24433) as a supporter; cobalt oxide, 4 weight % and molybdenum oxide 10 weight %.

(3) Hydrodesulfurization and hydrodenitrogenation catalyst alumina as the supporter; nickel oxide, 1 weight %; cobalt oxide, 1 weight %; and molybdenum oxide, 11 weight %.

(4) Conditions of hydrotreatment

| | |
|---|---|
| temperature | 390~410° C. |
| partial pressure of hydrogen | 160 kg/cm$^2$G |
| hydrogen/oil ratio | 800 Nm$^3$/kl |

Into a 1 liter fixed bed reactor, 20 volume % of the hydrodemetallization catalyst, 50 volume % of the hydrocracking catalyst and 30 volume % of the hydrodesulfurization and hydrodenitrogenation catalyst were charged in this order successively. The combined oil described above was treated in the condition described above. The combined oil was passed downward through the reaction vessel at the flow rate of 200 cc/hr.

The oil coming out of the reactor was treated according to the general method and then the liquid fraction was separated to fractions by the atmospheric distillation according to the general method. Result of the separation by distillation is shown in Table 24.

TABLE 24

| kind of the fraction | | yield | |
|---|---|---|---|
| gas | (~$C_4$) | 6.4 | (weight %) |
| light naphtha | ($C_5$~82° C.) | 3.8 | (volume %) |
| heavy naphtha | (82~150° C.) | 18.6 | (volume %) |
| gas oil | (150~343° C.) | 53.9 | (volume %) |
| residue | (343° C. or higher) | 104.7 | (volume %) |

2) Vacuum distillation of the hydrotreatment residue

The hydrotreatment residue formed in the hydrotreatment of 1) was vacuum distilled according to the general method and the vacuum gas oil I and the vacuum residue I were separated. Result of the separation by the vacuum distillation was as following.

(1) Properties of the hydrotreatment residue

| | |
|---|---|
| specific gravity | 0.923 |
| kinematic viscosity (50° C.) | 217 cSt |
| sulfur content | 0.46 weight % |
| nitrogen content | 1,290 ppm |
| carbon residue | 7.48 weight % |
| vanadium content | 0.7 ppm |
| nickel content | 2.1 ppm |

(2) Result of the vacuum distillation

| yield of the distilled fractions | |
|---|---|
| vacuum gas oil (VGO, 343~525° C.) | 44.4 volume % |
| vacuum residue (VR, 525° C. or higher) | 55.6 volume % |

3) Thermal hydrocracking of the vacuum residue (1) Properties of the vacuum residue

| | |
|---|---|
| specific gravity | 1.01 |

-continued

| | |
|---|---|
| kinematic viscosity (50° C.) | 1,850 cSt |
| sulfur content | 2.14 weight % |
| nitrogen content | 3,200 ppm |
| carbon residue | 22.5 weight % |
| vanadium content | 3.0 ppm |
| nickel content | 8.2 ppm |

(2) Reaction conditions

| | |
|---|---|
| reaction temperature | 450° C. |
| reaction pressure | 70 kg/cm$^2$ |
| LHSV | 0.35 hr$^{-1}$ |
| catalyst/oil ratio | 0.09 |
| reactor | a continuous autoclave reactor (700 cc) |

(3) Catalyst

| | |
|---|---|
| particle size | 30~200 μm diameter |
| used catalyst in the atmospheric residue hydrodesulfurization unit | 20 weight % (vanadium oxide, 0.7 weight %; nickel oxide, 2.2 weight %) |
| used catalyst in the fluid catalytic cracking unit | 80 weight % (vanadium oxide, 1,700 ppm; nickel oxide, 1,500 ppm) |

The vacuum residue I obtained by the vacuum distillation of 2) was treated according to the general method. The liquid fraction was separated to the vacuum gas oil II and the vacuum residue II according the general method by the atmospheric and vacuum distillations. Result of the distillation is shown in Table 25.

TABLE 25

| kind of the fraction | | yield | |
|---|---|---|---|
| gas | (~$C_4$) | 7.0 | (weight %) |
| naphtha | ($C_5$~150° C.) | 11.9 | (volume %) |
| kerosene | (150~232° C.) | 12.3 | (volume %) |
| gas | (232~343° C.) | 24.9 | (volume %) |
| vacuum gas oil | (343~525° C.) | 36.7 | (volume %) |
| vacuum residue | (525° C. or higher) | 10.5 | (volume %) |

The overall yield by the combination of the hydrotreatment and the thermal hydrocracking is shown in Table 26.

TABLE 26

| kind of the fraction | | yield | |
|---|---|---|---|
| gas | (~$C_4$) | 10.6 | (weight %) |
| light naphtha | ($C_5$~82° C.) | 5.2 | (volume %) |
| heavy naphtha | (82~150° C.) | 24.1 | (volume %) |
| gas oil | (150~343° C.) | 75.6 | (volume %) |
| residue | (343° C. or higher) | 0 | (volume %) |

When the result of Comparative Example 3 is compared with the results of Examples 7 and 8, the method of Comparative Example 3 produced only 15% of the kerosene and gas oil fraction because the method of Comparative Example 3 was focused on the production of FCC gasoline and, moreover, the quality of the gas oil produced in Comparative Example 3 was inferior because the method comprises the desulfurization but not the hydrotreatment. The quality of the gas oils are shown in Table 27.

TABLE 27

| property | Example 7 | Comparative Example 3 |
|---|---|---|
| sulfur (weight %) | 0.02 | 0.16 |

TABLE 27-continued

| property | Example 7 | Comparative Example 3 |
|---|---|---|
| nitrogen (ppm) | 42 | 400 |
| cold filter plugging point (°C.) | −20 | −5 |
| pour point (°C.) | −25.0 | −15.0 |

The gas oil produced in Example 7 had the lower contents of sulfur and nitrogen as well as the lower cold filter plugging point and pour point. On the other hand, the gas oil produced with the hydrodesulfurization in Comparative Example 3 needs to be treated with the hydrotreatment additionally when it is to be used as the diesel fuel for transportation. The oil produced in Comparative Example 3 contained about 25% of catalytically cracked gas oil fraction containing a large amount of polycyclic aromatic compounds and having a lower cetane number. Thus, the method of Comparative Example 3 is shown to be a method of lower value.

By the method of Examples 7 and 8, the naphtha fraction can be used as the feedstock for the production of reformed gasoline or for the production of BTX because the method produces the heavy naphtha. Because the production of kerosene and gas oil is remarkably higher than the method of Comparative Example 3, the method is advantageous For complying with the market requiring much middle distillate. The amount of the residue can be reduced to 2% or lower by this method in contrast to 9% by the method of Comparative Example 3 and this also clearly shows the advantage of the method of the invention.

Example 9 (Embodiment 5)

The same heavy hydrocarbon oil as the oil used in Example 3 was used as the feed oil.

1) Vacuum distillation of the atmospheric residue

The Arabian heavy atmospheric residue used as the feed oil was separated to the vacuum gas oil and the vacuum residue by the vacuum distillation by the general method. Result of the vacuum distillation is shown in the following.

(1) Result of the vacuum distillation

| yield of the distilled fractions | |
|---|---|
| vacuum gas oil (VGO, 343~525° C.) | 36.7 volume % |
| vacuum residue (VR, 525° C. or higher) | 63.3 volume % |

2) Thermal hydrocracking of the vacuum residue

The vacuum residue obtained by the vacuum distillation described above was thermally hydrocracked according to the general method in the following conditions.

(1) Properties of the vacuum residue

| | |
|---|---|
| specific gravity | 1.01 |
| kinematic viscosity (50° C.) | 4,520 cSt |
| sulfur content | 4.9 weight % |
| nitrogen content | 3,250 ppm |
| carbon residue | 20.9 weight % |
| vanadium content | 140 ppm |
| nickel content | 45 ppm |

(2) Reaction conditions

| | |
|---|---|
| reaction temperature | 450° C. |
| reaction pressure | 70 kg/cm$^2$ |

-continued

| | |
|---|---|
| LHSV | 0.43 hr$^{-1}$ |
| catalyst/oil ratio | 0.09 |
| reactor | a continuous autoclave reactor (700 cc) |

(3) Catalyst

| | |
|---|---|
| particle size | 30~200 μm diameter |
| used catalyst in the atmospheric residue hydrodesulfurization unit | 20 weight % (vanadium oxide, 0.7 weight %; nickel oxide, 2.2 weight %) |
| used catalyst in the fluid catalytic cracking unit | 80 weight % (vanadium oxide, 1,700 ppm; nickel oxide, 1,500 ppm) |

After the thermal hydrocracking, the product was treated by the method described above and the liquid fraction was separated to the vacuum gas oil and the vacuum residue according the general method by the atmospheric and vacuum distillations. Results of the separation by the distillation is shown in Table 28.

TABLE 28

| kind of the fraction | | yield | |
|---|---|---|---|
| gas | (~$C_4$) | 7.0 | (weight %) |
| naphtha | ($C_5$~150° C.) | 11.9 | (volume %) |
| kerosene | (150~232° C.) | 12.0 | (volume %) |
| gas oil | (232 ~343° C.) | 24.2 | (volume %) |
| vacuum gas oil | (343 ~525° C.) | 37.4 | (volume %) |
| vacuum residue | (525° C. or higher) | 10.4 | (volume %) |

3) Hydrotreatment (1) Properties of the treating oil (when recycled)

| | |
|---|---|
| specific gravity | 0.938 |
| kinematic viscosity (50° C.) | 95 cSt |
| sulfur content | 2.7 weight % |
| nitrogen content | 1,600 ppm |
| carbon residue | 2.7 weight % |
| vanadium content | 8 ppm |
| nickel content | 2 ppm |

(2) Hydrodemetallization catalyst alumina as the supporter; nickel oxide, 3 weight %, molybdenum oxide, 1.5 weight %; and vanadium oxide, 3 weight %.

(3) Hydrocracking catalyst

FeSHY-$Al_2O_3$ containing 65 weight % of FeSHY (an iron-containing aluminosilicate prepared by the method described in Example 1 in Laid Open Japanese Patent Application Heisei 2-289419) as a supporter; cobalt oxide, 4 weight % and molybdenum oxide 10 weight %.

(3) Hydrodesulfurization and hydrodenitrogenation catalyst alumina as the supporter; nickel oxide, 1 weight %,; cobalt oxide, 1 weight %; and molybdenum oxide, 11 weight %.

(4) Conditions of hydrotreatment

| | |
|---|---|
| temperature | 390~410° C. |
| partial pressure of hydrogen | 130 kg/cm$^2$ |
| hydrogen/oil ratio | 1,200 Nm$^3$/kl |

Into a 1 liter fixed bed, 20 volume % of the hydrodemetallization catalyst, 50 volume % of the hydrocracking catalyst and 30 volume % of the hydrodesulfurization and hydrodenitrogenation catalyst were charged in this order successively. The feed oil adding 12 volume % of the recycled oil was treated in the condition described above. The feed oil was passed downward through the reaction vessel at the flow rate of 200 cc/hr.

The hydrotreated oil was treated according to the general method and then the liquid fraction was separated to fractions by atmospheric distillation according to the general method. Result of the separation by distillation is shown in Table 29.

TABLE 29

| kind of the fraction | | yield | |
|---|---|---|---|
| gas | (~$C_4$) | 5.1 | (weight %) |
| light naphtha | ($C_5$~82° C.) | 6.8 | (volume %) |
| heavy naphtha | (82~150° C.) | 27.1 | (volume %) |
| gas oil | (150~343° C.) | 62.2 | (volume %) |
| residue | (343° C. or higher) | 14.9 | (volume %) |

The overall yields by the treatment of the hydrotreatment and the thermal hydrocracking are shown in Table 30.

TABLE 30

| kind of the fraction | | yield | |
|---|---|---|---|
| gas | (~$C_4$) | 10.9 | (weight %) |
| light naphtha | ($C_5$~82° C.) | 6.8 | (volume %) |
| heavy naphtha | (82~150° C.) | 27.4 | (volume %) |
| gas oil | (150~343° C.) | 71.9 | (volume %) |

Example 10 (Embodiment 5)

The same heavy hydrocarbon oil as the oil used in Example 1 was used as the feed oil.

1) Vacuum distillation of the atmospheric residue

The Arabian heavy atmospheric residue used as the feed oil was separated to the vacuum gas oil and the vacuum residue by the vacuum distillation by the general method. Result of the vacuum distillation is shown in the following.

(1) Result of the vacuum distillation

| yield of the distilled fractions | |
|---|---|
| vacuum gas oil (VGO, 343~525° C.) | 42.5 volume % |
| vacuum residue (VR, 525° C. or higher) | 57.5 volume % |

2) Thermal hydrocracking of the vacuum residue

The vacuum residue obtained by the vacuum distillation of 1) was thermally hydrocracked according to the general method in the following conditions.

(1) Properties of the vacuum residue

| | |
|---|---|
| specific gravity | 0.998 |
| kinematic viscosity (50° C.) | 3,670 cSt |
| sulfur content | 5.05 weight % |
| nitrogen content | 3,490 ppm |
| carbon residue | 21.5 weight % |
| vanadium content | 137 ppm |
| nickel content | 43 ppm |

(2) Reaction conditions

| | |
|---|---|
| reaction temperature | 450° C. |
| reaction pressure | 70 kg/cm$^2$ |
| LHSV | 0.45 hr$^{-1}$ |
| catalyst/oil ratio | 0.09 |

-continued

| | |
|---|---|
| reactor | a continuous autoclave reactor (700 cc) |

(3) Catalyst

| | |
|---|---|
| particle size | 30~200 μm diameter |
| used catalyst in the atmospheric residue hydrodesulfurization unit | 20 weight % (vanadium oxide, 0.7 weight %; nickel oxide, 2.2 weight %) |
| used catalyst in the fluid catalytic cracking unit | 80 weight % (vanadium oxide, 1,700 ppm; nickel oxide, 1,500 ppm) |

After the thermal hydrocracking, the product was treated by the general method and the liquid fraction was separated to the vacuum gas oil and the vacuum residue according the general method by the atmospheric and vacuum distillations. Results of the separation by the distillation is shown in Table 31.

TABLE 31

| kind of the fraction | | yield | |
|---|---|---|---|
| gas | (~$C_4$) | 6.8 | (weight %) |
| naphtha | ($C_5$~150° C.) | 9.8 | (volume %) |
| kerosene | (150~232° C.) | 10.9 | (volume %) |
| gas oil | (232~343° C.) | 22.2 | (volume %) |
| vacuum gas oil | (343~525° C.) | 32.7 | (volume %) |
| vacuum residue | (525° C. or higher) | 19.8 | (volume %) |

3) Hydrotreatment (1) Properties of the treating oil (when recycled)

| | |
|---|---|
| specific gravity | 0.943 |
| kinematic viscosity (50° C.) | 125 cSt |
| sulfur content | 2.9 weight % |
| nitrogen content | 1,970 ppm |
| carbon residue | 3.5 weight % |
| vanadium content | 12 ppm |
| nickel content | 5 ppm |

(2) Hydrodemetallization catalyst alumina as the supporter; nickel oxide, 3 weight %, molybdenum oxide, 1.5 weight %; and vanadium oxide, 3 weight %.

(3) Hydrocracking catalyst

FeSHY-$Al_2O_3$ containing 65 weight % of FeSHY (an iron-containing aluminosilicate prepared by the method described in Example 1 in Japanese Patent Publication Showa 61-24433) as a supporter; nickel oxide, 1 weight %, cobalt oxide, 1 weight % and molybdenum oxide 10 weight %.

(3) Hydrodesulfurization and hydrodenitrogenation catalyst

γ-alumina as the supporter; nickel oxide, 1 weight %; cobalt oxide, 1 weight %; and molybdenum oxide, 11 weight %.

(4) Conditions of hydrotreatment

| | |
|---|---|
| temperature | 390~410° C. |
| partial pressure of hydrogen | 130 kg/cm$^2$ |
| hydrogen/oil ratio | 1,200 Nm$^3$/kl |

Into a 1 liter fixed bed reactor, 20 volume % of the hydrodemetallization catalyst, 50 volume % of the hydrocracking catalyst and 30 volume % of the hydrodesulfurization and hydrodenitrogenation catalyst were charged in this order successively. The feed oil adding 12 volume % of recycled oil was treated in the condition described above. The feed oil was passed downward through the reaction vessel at the flow rate of 200 cc/hr.

The hydrotreated oil was treated according to the general method and then the liquid fraction was separated to fractions by the atmospheric distillation according to the conventional method. Result of the separation by distillation is shown in Table 32.

TABLE 32

| kind of the fraction | | yield | |
|---|---|---|---|
| gas | (~$C_4$) | 5.2 | (weight %) |
| light naphtha | ($C_5$~82° C.) | 6.8 | (volume %) |
| heavy naphtha | (82~150° C.) | 27.3 | (volume %) |
| gas oil | (150~343° C.) | 63.5 | (volume %) |
| residue | (343° C. or higher) | 13.9 | (volume %) |

The overall yields by the treatment of the thermal hydrocracking and the hydrotreatment are shown in Table 33.

TABLE 33

| kind of the fraction | | yield | |
|---|---|---|---|
| gas | (~$C_4$) | 7.9 | (weight %) |
| light naphtha | ($C_5$~82° C.) | 6.9 | (volume %) |
| heavy naphtha | (82~150° C.) | 27.4 | (volume %) |
| gas oil | (150~343° C.) | 72.5 | (volume %) |

When the result of Comparative Example 3 is compared with the results of Examples 9 and 10, the method of Comparative Example 3 produced only 15% of the kerosene and gas oil because the method of Comparative Example 3 was focused on the production of FCC gasoline and, moreover, the quality of the gas oil produced in Comparative Example 3 is inferior because the method comprises the desulfurization but not the hydrotreatment. The quality of the gas oils are shown in Table 34.

TABLE 34

| property | Example 9 | Comparative Example 3 |
|---|---|---|
| sulfur (weight %) | 0.01 | 0.16 |
| nitrogen (ppm) | 35 | 400 |
| cold filter plugging point (° C.) | −22.5 | −5 |
| pour point (° C.) | −27.0 | −15.0 |

The gas oil produced in Examples 9 and 10 had the lower contents of sulfur and nitrogen as well as the lower cold filter plugging point and pour point. On the other hand, the gas oil produced by the hydrodesulfurization in Comparative Example 3 needs to be treated with the hydrotreatment additionally when it is to be used as the diesel fuel for transportation. The oil produced in Comparative Example 3 contained about 25% of catalytically cracked gas oil fraction containing a large amount of polycyclic aromatic compounds and having a lower cetane number. Thus, the method of Comparative Example 3 is shown to be a method of lower value.

By the method of Examples 9 and 10, the products can be used as the feed stock for the production of reformed gasoline or for the production of BTX because the method produces heavy naphtha. Because the production of kerosene and gas oil is remarkably higher than the method of Comparative Example 3, the method is advantageous For complying with the market requiring much middle distillate. The amount of the residue can be reduced by this method in contrast to the amount of 9% by the method of Comparative Example 3 and this also clearly shows the advantage of the method of the invention.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In a method of hydrotreatment of a heavy hydrocarbon oil in the presence of catalysts, the improvement which comprises successively hydrodemetallizing and hydrocracking the heavy hydrocarbon oil, said hydrocracking being carried out in the presence of a catalyst which comprises one or more metals or compounds of metals of the group VIB or the group VIII of the Periodic Table, supported on a carrier comprising 10 to 90 weight % of an iron-containing aluminosilicate and 90 to 10 weight % of an inorganic oxide, and thereafter hydrodesulfurizing and hydrodenitrogenating the treated hydrocarbon oil.

2. The method of claim 1, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight %, a specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 $kg/cm^2G$, a hydrogen/oil ratio of 300 to 2,000 $Nm^3kl$ and a liquid hourly space velocity of 0.1 to 10 $hr^{-1}$; the hydrocracking being carried out at a reaction temperature of 300° to 450° C., a partial pressure of hydrogen of 30 to 200 $kg/cm^2G$, a hydrogen/oil ratio of 300 to 2,000 $Nm^3kl$ and a liquid hourly space velocity of 0.1 to 2.0 $hr^{-1}$; the hydrodesulfurization and the hydrodenitrogenation being carried out at a reaction temperature of 300° to 450° C., a partial pressure of hydrogen of 30 to 200 $kg/cm^2G$, a hydrogen/oil ratio of 300 to 2,000 $Nm^3kl$ and a liquid hourly space velocity of 0.1 to 0.5 $hr^1$.

3. In a method of treatment of a heavy hydrocarbon oil which comprises hydrotreating the heavy hydrocarbon oil in the presence of catalysts, the improvement comprising fractionating the hydrotreated heavy hydrocarbon oil by distillation whereby a residue is produced and fluid catalytically cracking the residue, the hydrotreatment comprising successively hydrodemetallizing and hydrocracking the heavy hydrocarbon oil, said hydrocracking being carried out in the presence of a catalyst comprising one or more metals or compounds of metals of the group VIB or the group VIII of the Periodic Table supported on a carrier comprising 10 to 90 weight % of an iron-containing aluminosilicate and 90 to 10 weight % of an inorganic oxide, and thereafter hydrodesulfurizing and hydrodenitrogenating the treated heavy hydrocarbon oil.

4. The method of claim 3, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight %, a specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 10 hr$^{-1}$; the hydrocracking being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 2.0 hr$^{-1}$; the hydrodesulfurization and the hydrodenitrogenation being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 0.5 hr$^{-1}$.

5. In a method of treatment of heavy hydrocarbon oil which comprises hydrotreating the heavy hydrocarbon oil in the presence of catalysts, the improvement comprising separating the hydrotreated heavy hydrocarbon oil into a vacuum gas oil I and vacuum residue I by atmospheric and vacuum distillations, thermal hydrocracking the vacuum residue I with a slurry bed, separating the thermal hydrocracked oil into a vacuum gas oil II and a vacuum residue II by atmospheric and vacuum distillations and fluid catalytically cracking the vacuum gas oil II and the vacuum gas oil I, the hydrotreatment comprising successively hydrodemetallizing and hydrocracking the heavy hydrocarbon oil, said hydrocracking being carried out in the presence of a catalyst which comprises one or more metals or compounds of metals of the group VIB or the group VIII of the Periodic Table supported on a carrier comprising 10 to 90 weight % of an iron-containing aluminosilicate and 90 to 10 weight % of an inorganic oxide, said thermal hydrocracking being carried out in the presence of a catalyst comprising an oxide of one or more metals of the group VIB and the group VIII of the Periodic Table supported on a carrier selected from the group consisting of alumina, silica, silica-alumina, silica-alumina-magnesia and alumina-titania, and thereafter hydrodesulfurizing and hydrodenitrogenating the treated heavy hydrocarbon oil.

6. The method of claim 5, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight %, a specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 10 hr$^{-1}$; the hydrocracking being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 2.0 hr$^{-1}$; the hydrodesulfurization and the hydrodenitrogenation being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 0.5 hr$^{l}$; the thermal hydrocracking being carried out at a reaction temperature of 370° to 480° C., a partial pressure of hydrogen of 30 to 200 kg/cm$^2$, a liquid hourly space velocity of 0.1 to 2.0 hr$^{-1}$ and a catalyst to oil weight ratio of 0.01 to 0.30.

7. In a method of treatment of heavy hydrocarbon oil which comprises hydrotreating the heavy hydrocarbon oil in the presence of catalysts, the improvement comprising separating the hydrotreated heavy hydrocarbon oil into a vacuum gas oil I and a vacuum residue I by atmospheric and vacuum distillations, thermal hydrocracking the vacuum residue I with a slurry bed, separating the thermal hydrocracked oil into a vacuum gas oil II and a vacuum residue II by atmospheric and vacuum distillations and fluid catalytically cracking the vacuum gas oil II, the vacuum gas oil I and at least a part of the vacuum residue II, the hydrotreatment comprising successively hydrodemetallizing and hydrocracking the heavy hydrocarbon oil, said hydrocracking being carried out in the presence of a catalyst which comprises one or more metals or compounds of metals of the group VIB or the group VIII of the Periodic Table supported on a carrier comprising 10 to 90 weight % of an iron-containing aluminosilicate and 90 to 10 weight % of an inorganic oxide, said thermal hydrocracking being carried out in the presence of a catalyst comprising an oxide of one or more metals of the group VIB and the group VIII of the Periodic Table supported on a carrier selected from the group consisting of alumina, silica, silica-alumina, silica-alumina-magnesia and alumina-titania, and thereafter hydrodesulfurizing and hydrodenitrogenating the treated heavy hydrocarbon oil.

8. The method of claim 7, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight %, a specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 10 hr$^{-1}$; the hydrocracking being carried out at a reaction temperature of 300° to 450 °C., a partial pressure of hydrogen of 30 to 200 kg/cm$^2$G, a hydrogen/oil ratio of 300 to 2,000 Nm$^3$kl and a liquid hourly space velocity of 0.1 to 2.0 hr$^{-1}$; the hydrodesulfurization and the hydrodenitrogenation being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 0.5 hr$^{-1}$; the thermal hydrocracking being carried out at a reaction temperature of 370° to 480 °C., a partial pressure of hydrogen of 30 to 200 kg/cm$^2$, a liquid hourly space velocity of 0.1 to 2.0 hr$^{-1}$ and a catalyst to oil weight ratio of 0.01 to 0.30.

9. In a method of treatment of heavy hydrocarbon oil which comprises hydrotreating the heavy hydrocarbon oil in the presence of catalysts, the improvement comprising separating the hydrotreated heavy hydrocarbon oil into a vacuum gas oil I and a vacuum residue I by atmospheric and vacuum distillations, thermal hydrocracking the vacuum residue I with a slurry bed, separating the thermal hydrocracked oil into a vacuum gas oil II and a vacuum residue II by atmospheric and vacuum distillations and recycling the vacuum gas oil II and the vacuum gas oil I to a stage before or after hydrodemetallizing the heavy hydrocarbon oil in the hydrotreatment, the hydrotreatment comprising successively hydrodemetallizing and hydrocracking the heavy hydrocarbon oil, said hydrocracking being carried out in the presence of a catalyst which comprises one or more metals or compounds of metals of the group VIB or the group VIII of the Periodic Table supported on a carrier comprising 10 to 90 weight % of an iron-containing aluminosilicate and 90 to 10 weight % of an inorganic oxide, said thermal hydrocracking being carried out in the presence of a catalyst comprising an oxide of one or more metals of the group VIB and the group VIII of the Periodic Table supported on a carrier selected from the group consisting of alumina, silica, silica-alumina, silica-alumina-magnesia and alumina-titania, and thereafter hydrodesulfurizing and hydrodenitrogenating the treated heavy hydrocarbon oil.

10. The method of claim 9, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight %, a specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 10 hr$^{-1}$; the hydrocracking being carried out at a reaction temperature of 300° to 450° C., a partial pressure of hydrogen to 30 to 200 kg/cm$^2$G, a hydrogen/oil ratio of 300 to 2,000 Nm$^3$kl and a liquid hourly space velocity of 0.1 to 2.0 hr$^{-1}$; the hydrodesulfurization and the hydrodenitrogenation being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 0.5 hr$^{-1}$; the thermal hydrocracking being carried out at a reaction temperature of 370° to 480° C., a partial pressure of hydrogen of 30 to 200 kg/cm$^2$, a liquid hourly space velocity of 0.1 to 2.0 hr$^{-1}$ and a catalyst to oil weight ratio of 0.01 to 0.30.

11. In a method of treatment of heavy hydrocarbon oil which comprises hydrotreating the heavy hydrocarbon oil in the presence of catalysts, the improvement comprising separating the hydrotreated heavy hydrocarbon oil into a vacuum gas oil I and a vacuum residue I by atmospheric and vacuum distillations, thermal hydrocracking the vacuum residue I with a slurry bed, separating the thermal hydrocracked oil into a vacuum gas oil II and a vacuum residue II by atmospheric and vacuum distillations and recycling the vacuum gas oil II, the vacuum gas oil I and at least a part of the vacuum residue II to a stage before or after hydrodemetallizing the heavy hydrocarbon oil, the hydrotreatment comprising successively hydrodemetallizing and hydrocracking the heavy hydrocarbon oil, said hydrocracking being carried out in the presence of a catalyst which comprises one or more metals or compounds of metals of the group VIB or the group VIII of the Periodic Table supported on a carrier comprising 10 to 90 weight % of an iron-containing aluminosilicate and 90 to 10 weight % of an inorganic oxide, said thermal hydrocracking being carried out in the presence of a catalyst comprising an oxide of one or more metals of the group VIB and the group VIII of the Periodic Table supported on a carrier selected from the group consisting of alumina, silica, silica-alumina, silica-alumina-magnesia and alumina-titania, and thereafter hydrodesulfurizing and hydrodenitrogenating the treated hydrocarbon oil.

12. The method of claim 11, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight %, a specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 10 hr$^{-1}$; the hydrocracking being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 2.0 hr$^{-1}$; the hydrodesulfurization and the hydrodenitrogenation being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 0.5 hr$^{-1}$; the thermal hydrocracking being carried out at a reaction temperature of 370° to 480° C., a partial pressure of hydrogen of 30 to 200 kg/cm$^2$, a liquid hourly space velocity of 0.1 to 2.0 hr$^{-1}$ and a catalyst to oil weight ratio of 0.01 to 0.30.

13. In a method of treatment of heavy hydrocarbon oil in the presence of a catalyst, the improvement which comprises separating the heavy hydrocarbon oil into a vacuum gas oil and a vacuum residue by vacuum distillation, thermal hydrocracking the vacuum residue with a slurry bed, separating the thermal hydrocracked vacuum residue into a light fraction and a residue fraction by fractionation and hydrotreating the residue fraction and the vacuum gas oil in the presence of catalysts, the hydrotreatment comprising successively hydrodemetallizing and hydrocracking the residue fraction and the vacuum gas oil, said hydrocracking being carried out in the presence of a catalyst which comprises one or more metals or compounds of metal of the group VIB or the group VIII of the Periodic Table supported on a carrier comprising 10 to 90 weight % of an iron-containing aluminosilicate and 90 to 10 weight % of an inorganic oxide, said thermal hydrocracking being carried out in the presence of a catalyst comprising an oxide of one or more metals of the group VIB and the group VIII of the Periodic Table supported on a carrier selected from the group consisting of alumina, silica, silica lumina, silica-alumina-magnesia and alumina-titania, and thereafter hydrodesulfurizing and hydrodenitrogenating the treated oil.

14. The method of claim 13, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight %, a specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 10 hr$^{-1}$; the hydrocracking being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 2.0 hr$^{-1}$; the hydrodesulfurization and the hydrodenitrogenation being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 0.5 hr$^{-1}$; the thermal hydrocracking being carried out at a reaction temperature of 370° to 480° C., a partial pressure of hydrogen of 30 to 200 kg/cm$^2$, a liquid hourly space velocity of 0.1 to 2.0 hr$^{-1}$ and a catalyst to oil weight ratio of 0.01 to 0.30.

15. In a method of treatment of heavy hydrocarbon oil in the presence of a catalyst, the improvement which comprises separating the heavy hydrocarbon oil to a vacuum gas oil and a vacuum residue by vacuum distillation, thermal hydrocracking the vacuum residue with a slurry bed, separating the thermal hydrocracked vacuum residue into a light fraction and a residue fraction by fractionation, hydrotreating the residue fraction and the vacuum gas oil in the presence of catalysts and recycling at least a part of the residue fraction obtained by the fractionation to a stage before or after hydrodemetallizing, the hydrotreatment comprising successively hydrodemetallizing and hydrocracking the residue fraction and the vacuum gas oil, said hydrocracking being carried out in the presence of a catalyst which comprises one or more metals or compounds of metals of the group VIB or the group VIII of the Periodic Table supported on a carrier comprising 10 to 90 weight % of an iron-containing aluminosilicate and 90 to 10 weight % of an inorganic oxide, said thermal hydrocracking being carried out in the presence of a catalyst comprising an oxide of one or more metals of the group VIB and the group VIII of the Periodic Table supported on a carrier selected from the group consisting of alumina, silica, silica-alumina, silica-alumina-magnesia and alumina-titania, and thereafter hydrodesulfurizing and hydrodenitrogenating the treated oil.

16. The method of claim 15, wherein 90 weight % or more of the heavy hydrocarbon oil has a boiling point of 343° C. or higher, the heavy hydrocarbon oil having a metal content of 20 to 150 ppm, a sulfur content of 1.0 to 5.0 weight %, a carbon residue of 2 to 18 weight %, an asphaltene concentration 1 to 10 weight % a , specific gravity of 0.78 to 0.95, and a kinematic viscosity of 1.8 to 20 cSt measured at 100° C.; the hydrodemetallization being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 10 hr$^{-1}$; the hydrocracking being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 2.0 hr$^{-1}$; the hydrodesulfurization and the hydrodenitrogenation being carried out at a reaction temperature of 300° to 450° C., a partial pressure of hydrogen of 30 to 200 kg/cm$^2$G, a hydrogen/oil ratio of 300 to 2,000 Nm$^3$kl and a liquid hourly space velocity of 0.1 to 0.5 hr$^{-1}$; the thermal hydrocracking being carried out at a reaction temperature of 370° to 480° C., a partial pressure of hydrogen of 30 to 200 kg/cm$^2$, a liquid hourly space velocity of 0.1 to 2.0 hr$^{-1}$ and a catalyst to oil weight ratio of 0.01 to 0.30.

* * * * *